US008487921B2

(12) United States Patent
Shimatani

(10) Patent No.: US 8,487,921 B2
(45) Date of Patent: Jul. 16, 2013

(54) DISPLAY PANEL DRIVER AND DISPLAY APPARATUS USING THE SAME

(75) Inventor: Atsushi Shimatani, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 799 days.

(21) Appl. No.: 12/659,452

(22) Filed: Mar. 9, 2010

(65) Prior Publication Data

US 2010/0231569 A1 Sep. 16, 2010

(30) Foreign Application Priority Data

Mar. 11, 2009 (JP) ..... 2009-057416

(51) Int. Cl.
*G09G 5/00* (2006.01)

(52) U.S. Cl.
USPC ..... 345/211; 330/252

(58) Field of Classification Search
USPC ..... 345/87–100, 204; 330/9, 252–257
See application file for complete search history.

(56) References Cited

U.S. PATENT DOCUMENTS 6,049,229 A * 4/2000 Manohar et al. ..... 326/83
6,424,219 B1 7/2002 Kato
7,551,030 B2 * 6/2009 An et al. ..... 330/255
7,671,831 B2 * 3/2010 Chang et al. ..... 345/100
8,184,083 B2 * 5/2012 Chung ..... 345/98
8,217,925 B2 * 7/2012 Nishimura ..... 345/204
8,237,693 B2 * 8/2012 Nishimura et al. ..... 345/204
8,289,079 B2 * 10/2012 Nishimura ..... 330/260
8,310,280 B2 * 11/2012 Huang et al. ..... 327/72
8,310,422 B2 * 11/2012 Nishimura ..... 345/87
8,310,428 B2 * 11/2012 Nakayama ..... 345/96
2002/0067207 A1 6/2002 Kato
2009/0040165 A1 * 2/2009 Shimatani ..... 345/98
2009/0045874 A1 * 2/2009 Kang et al. ..... 330/253
2009/0167667 A1 * 7/2009 Suzuki ..... 345/96

FOREIGN PATENT DOCUMENTS

JP 2002-175052 A 6/2002

* cited by examiner

*Primary Examiner* — Amare Mengistu
*Assistant Examiner* — Stacy Khoo
(74) *Attorney, Agent, or Firm* — McGinn IP Law Group, PLLC

(57) ABSTRACT

In a display panel driver an output amplifier circuit includes a first output stage to receive a power supply voltage and a first voltage lower thereto and to output a drive voltage in a first voltage range defined between the power supply voltage and a middle power supply voltage; and a second output stage to receive the power supply and ground voltages and to output a drive voltage between the power supply and ground voltages. In a first mode that the first voltage is set as the middle power supply voltage, the first output stage outputs a first drive voltage in the first voltage range to one of first and second output terminals. In a second mode that the first voltage is set as the ground voltage, the second output stage outputs a first drive voltage in the first voltage range to one of the first and second output terminals.

10 Claims, 13 Drawing Sheets

16A
V2i-1
ODD OUTPUT
26
16B
V2i
EVEN OUTPUT
SW601
SW602
SW605
SW606
36A
36B
25
24A:POSITIVE-ONLY OUTPUT STAGE
SW501
SW502
SW505
SW506
VDD
VDD/2
VDD/2
VSS
24B:
33A
33B
35A
35B
22A:DIFFERENTIAL STAGE
22B:DIFFERENTIAL STAGE NEGATIVE-ONLY OUTPUT STAGE
SW301
SW302
SW305
SW306
SW307
SW308
SW311
SW312
32A
32B
34A
34B
VDD
VSS
VDD
VSS
31A
Vin1
31B
Vin2
21
23
SWITCH CONTROL SIGNAL
CONTROL CIRCUIT
SW101
SW102
SW103
SW104
POL
27
30A
FROM POSITIVE DAC
30B
FROM NEGATIVE DAC
14:OUTPUT AMPLIFIER CIRCUIT

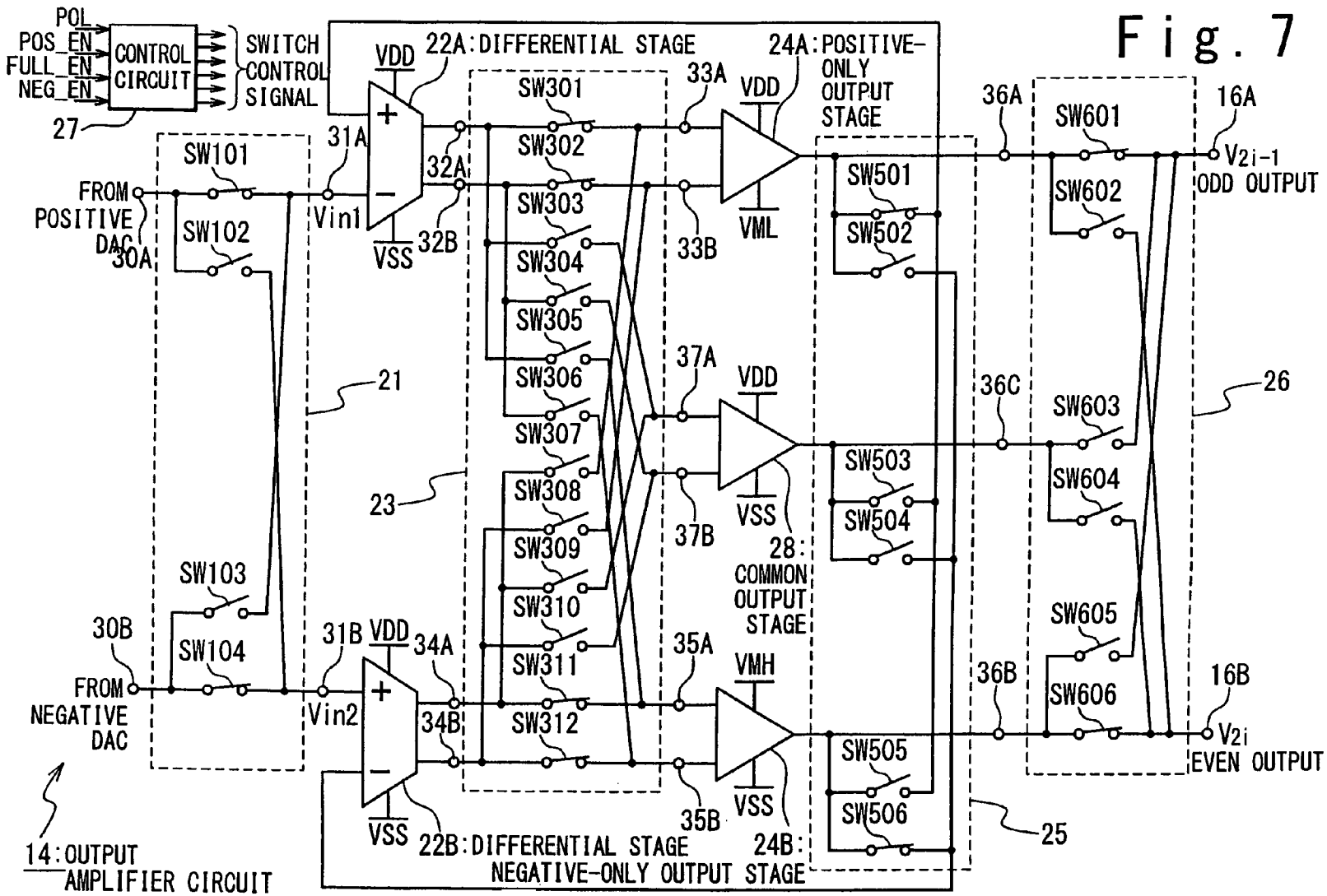
Fig. 7
16A
V2i-1
ODD OUTPUT
26
16B
V2i
EVEN OUTPUT
SW601
SW602
SW603
SW604
SW605
SW606
36A
36C
36B
25
SW501
SW502
SW503
SW504
SW505
SW506
24A: POSITIVE-ONLY OUTPUT STAGE
VDD
VML
VDD
VSS
28: COMMON OUTPUT STAGE
VMH
VSS
24B: NEGATIVE-ONLY OUTPUT STAGE
33A
33B
37A
37B
35A
35B
22A: DIFFERENTIAL STAGE
SW301
SW302
SW303
SW304
SW305
SW306
SW307
SW308
SW309
SW310
SW311
SW312
22B: DIFFERENTIAL STAGE
32A
32B
34A
34B
VDD
VSS
VDD
VSS
21
23
31A
Vin1
31B
Vin2
SWITCH CONTROL SIGNAL
SW101
SW102
SW103
SW104
CONTROL CIRCUIT
POL
POS_EN
FULL_EN
NEG_EN
27
FROM POSITIVE DAC
30A
30B
FROM NEGATIVE DAC
14: OUTPUT AMPLIFIER CIRCUIT

| | FULL VDD MODE | HALF VDD MODE | |
|---|---|---|---|
| POSITIVE DRIVE VOLTAGE OUTPUT | COMMON OUTPUT STAGE 28 | POSITIVE-ONLY OUTPUT STAGE 24A | |
| NEGATIVE DRIVE VOLTAGE OUTPUT | NEGATIVE-ONLY OUTPUT STAGE 24B | WITH POLARITY SWITCHING | COMMON OUTPUT STAGE 28 |
| | | WITH NO POLARITY SWITCHING | NEGATIVE-ONLY OUTPUT STAGE 24B |

| | FULL VDD MODE | HALF VDD MODE |
|---|---|---|
| POSITIVE DRIVE VOLTAGE OUTPUT | COMMON OUTPUT STAGE 28 | POSITIVE-ONLY OUTPUT STAGE 24A |
| NEGATIVE DRIVE VOLTAGE OUTPUT | NEGATIVE-ONLY OUTPUT STAGE 24B | COMMON OUTPUT STAGE 28 |

DISPLAY PANEL DRIVER AND DISPLAY APPARATUS USING THE SAME

INCORPORATION BY REFERENCE

This application claims a priority on convention based on Japanese Patent Application No. 2009-057416. The disclosure thereof is incorporated herein by reference.

TECHNICAL FIELD

The present invention relates to a display panel driver, and more particularly, to an output amplifier circuit of the display panel driver.

BACKGROUND ART

One of recent problems of a display apparatus using a display panel is increase in a power consumption amount of a display panel driver that drives the display panel. One cause of the increase in the power consumption amount is increase in a size of the display panel. In the field of television, in particular, even in a case of a liquid crystal display panel, a television set exceeding 100 inches are in the market, and it is thought that this trend does not change in the future. As the size of the display panel increases, the capacitance of a data line increases, so that a power consumption amount of an output amplifier circuit that drives the data line increases. In addition, in the recent display apparatus, in order to decrease the number of drivers to be used, the number of outputs per one display panel driver tends to increase more and more, and therefore the power consumption amount of the display panel driver also increases more and more. For this reason, a temperature of the display panel driver in operation is increased.

One measure against the increase in the power consumption amount of the display panel driver is to supply an intermediate voltage between the power supply voltage VDD and a ground voltage VSS (=0 V) (typically, the intermediate voltage VDD/2 that is a half of a power supply voltage VDD), in addition to the power supply voltage VDD, and the intermediate power supply voltage is used to operate an output amplifier of the driver. For example, an amplifier that outputs an output voltage in the voltage range of VDD/2 to VDD is operated by use of the intermediate power supply voltage VDD/2 and the power supply voltage VDD, and an amplifier that operates in a voltage range of 0 to VDD/2 is operated by use of the intermediate power supply voltage VDD/2 and the ground voltage VSS. Thus, a power consumed in the amplifiers can be reduced. Such a technique is disclosed in, for example, Japanese Patent Publication (JP 2002-175052A).

However, the recent display panel driver is required to be operable in a low voltage to further reduce the power consumption amount. Currently, a driver for a liquid crystal display apparatus operates typically at 1.5 V; however, to suppress heat generation of the driver, the driver preferably operates at lower power supply voltage.

In addition, according to consideration by the inventor, it is advantageous in practice that the display panel driver is operable regardless of the presence or absence of supply of an intermediate power supply voltage. Of end manufacturers of display apparatuses, there are one who desires to reduce the power consumption amount by supplying the intermediate power supply voltage, and one who desires to simplify the configuration without supplying the intermediate power supply voltage. On the other hand, manufacturing respective types of display panel drivers with supply of the intermediate power supply voltage and with no supply of it causes increase in manufacturing cost. Cost reduction is preferable even for manufacturers of the display panel drivers and even for the end manufacturers of the display apparatuses.

However, a circuit described in the above Patent literature 1 cannot meet such requirements.

CITATION LIST

1. Patent Literature

Patent literature 1: JP 2002-175052A

SUMMARY OF THE INVENTION

In an aspect of the present invention, a display panel driver includes an output amplifier circuit; a first output terminal; and a second output terminal. The output amplifier circuit includes a first output stage configured to receive a power supply voltage and a first voltage lower than the power supply voltage and to output a drive voltage in a first voltage range defined between the power supply voltage and a middle power supply voltage which is higher than a ground voltage and is lower than the power supply voltage; and a second output stage configured to receive the power supply voltage and the ground voltage and to output a drive voltage between the power supply voltage and the ground voltage. The first output stage comprises a first pull-down output transistor configured to pull down an output terminal of the first output stage, and the second output stage comprises a second pull-down output transistor configured to pull down an output terminal of the second output stage. The first pull-down output transistor is a depletion-type NMOS transistor, and the second pull-down output transistor is an enhancement-type NMOS transistor. When the output amplifier circuit is set to a first mode that the first voltage is set as the middle power supply voltage, the first output stage outputs a first drive voltage in the first voltage range to one of the first output terminal and the second output terminal. When the output amplifier circuit is set to a second mode that the first voltage is set as the ground voltage, the second output stage outputs a first drive voltage in the first voltage range to one of the first output terminal and the second output terminal.

In another aspect of the present invention, a display panel driver includes an output amplifier circuit; a first output terminal; and a second output terminal. The output amplifier circuit includes a first output stage configured to output a drive voltage in a first voltage range between a power supply voltage and a middle power supply voltage which is higher than a ground voltage and is lower than the power supply voltage; a second output stage configured to receive the power supply voltage and the ground voltage and to output a drive voltage between the power supply voltage and the ground voltage; and a third output stage configured to receive the ground voltage and a second voltage which is higher than the ground voltage and to output a drive voltage in a second voltage range between the ground voltage and the middle power supply voltage. The third output stage comprises a first pull-up output transistor configured to pull up an output terminal of the third output stage, and the second output stage comprises a second pull-up output transistor configured to pull up an output terminal of the second output stage. The first pull-up output transistor is a PMOS transistor, of which a well is separated from other PMOS transistors and a back gate is connected with a source, and the second pull-up output transistor is a PMOS transistor of which a source is supplied with the power supply voltage. When the output amplifier circuit is set to a first mode in which the second voltage is set to the middle power supply voltage, the second output stage outputs a second drive voltage in the second voltage range to one of the first output terminal and the second output terminal in at least a case that a voltage at the one output terminal is switched from a voltage in the first voltage range to a voltage in the second voltage range. When the output amplifier circuit is set to a second mode in which the second voltage is set to the power supply voltage, the third output stage outputs a second drive voltage in the second voltage range to the one output terminal.

In another aspect of the present invention, a display apparatus includes a display panel comprising a first data line and a second data line; and a display panel driver. The display panel driver includes an output amplifier circuit; a first output terminal connected with the first data line; and a second output terminal connected with the second data line. The output amplifier circuit includes a first output stage configured to receive a power supply voltage and a first voltage which is lower than the power supply voltage, and output a drive voltage in a first voltage range between the power supply voltage and a middle power supply voltage which is higher than a ground voltage and is lower than the power supply voltage; and a second output stage configured to receive the power supply voltage and the ground voltage and output a drive voltage between the power supply voltage and the ground voltage. The first output stage comprises a first pull-down output transistor configured to pull down an output terminal of the first output stage, and the second output stage comprises a second pull-down output transistor configured to pull-down an output terminal of the second output stage. The first pull-down output transistor is a depletion-type NMOS transistor, and the second pull-down output transistor is an enhancement-type NMOS transistor. When the output amplifier circuit is set to a first mode in which the first voltage is set as the middle power supply voltage, the first output stage outputs a first drive voltage in the first voltage range to one of the first output terminal and the second output terminal. When the output amplifier circuit is set to a second mode in which the first voltage is set as the ground voltage, the second output stage outputs the first drive voltage in the first voltage range to the one output terminal of the first output terminal and the second output terminal.

In still another aspect of the present invention, a display apparatus includes a display panel comprising a first data line and a second data line; and a display panel driver. The display panel driver includes an output amplifier circuit; a first output terminal connected with the first data line; and a second output terminal connected with the second data line. The output amplifier circuit includes a first output stage configured to output a drive voltage in a first voltage range between a power supply voltage and a middle power supply voltage which is higher than a ground voltage and is lower than the power supply voltage; a second output stage configured to receive the power supply voltage and the ground voltage and to output a drive voltage between the power supply voltage and the ground voltage; and a third output stage configured to receive the ground voltage and a second voltage which is higher than the ground voltage and to output in a drive voltage in a second voltage range between the ground voltage and the middle power supply voltage. The third output stage comprises a first pull-up output transistor configured to pull up an output terminal of the third output stage, and the second output stage comprises a second pull-up output transistor configured to pull up an output terminal of the second output stage. The first pull-up output transistor is a PMOS transistor, of which a well is separated from other PMOS transistors and a back gate is connected with a source, and the second pull-up output transistor is a PMOS transistor, of which a source is supplied with the power supply voltage. When the output amplifier circuit is set to a first mode in which the second voltage is set as the middle power supply voltage, the second output stage outputs a second drive voltage in the second voltage range to the one output terminal, in at least a case that a voltage of the one output terminal is switched from a voltage in the first voltage range to a voltage in the second voltage range. When the output amplifier circuit is set to a second mode in which the second voltage is set as the power supply voltage, the third output stage outputs the second drive voltage in the second voltage range to the one output terminal.

According to the present invention, there is provided a display panel driver that is operable at low voltage, and yet operable regardless of the presence or absence of supply of an intermediate power supply voltage.

BRIEF DESCRIPTION OF THE DRAWINGS

The above and other objects, advantages and features of the present invention will be more apparent from the following description of certain embodiments taken in conjunction with the accompanying drawings, in which:

FIG. 7 is a circuit diagram illustrating a configuration of an output amplifier circuit in one embodiment of the present invention;

DESCRIPTION OF EMBODIMENTS

Hereinafter, a display panel driver such as a liquid crystal display (LCD) panel driver of the present invention will be described in detail with reference to the attached drawings. However, one skilled in the art would be obvious that the present invention can be applied to a display panel driver that drives another type of display panel.

Figure 1:
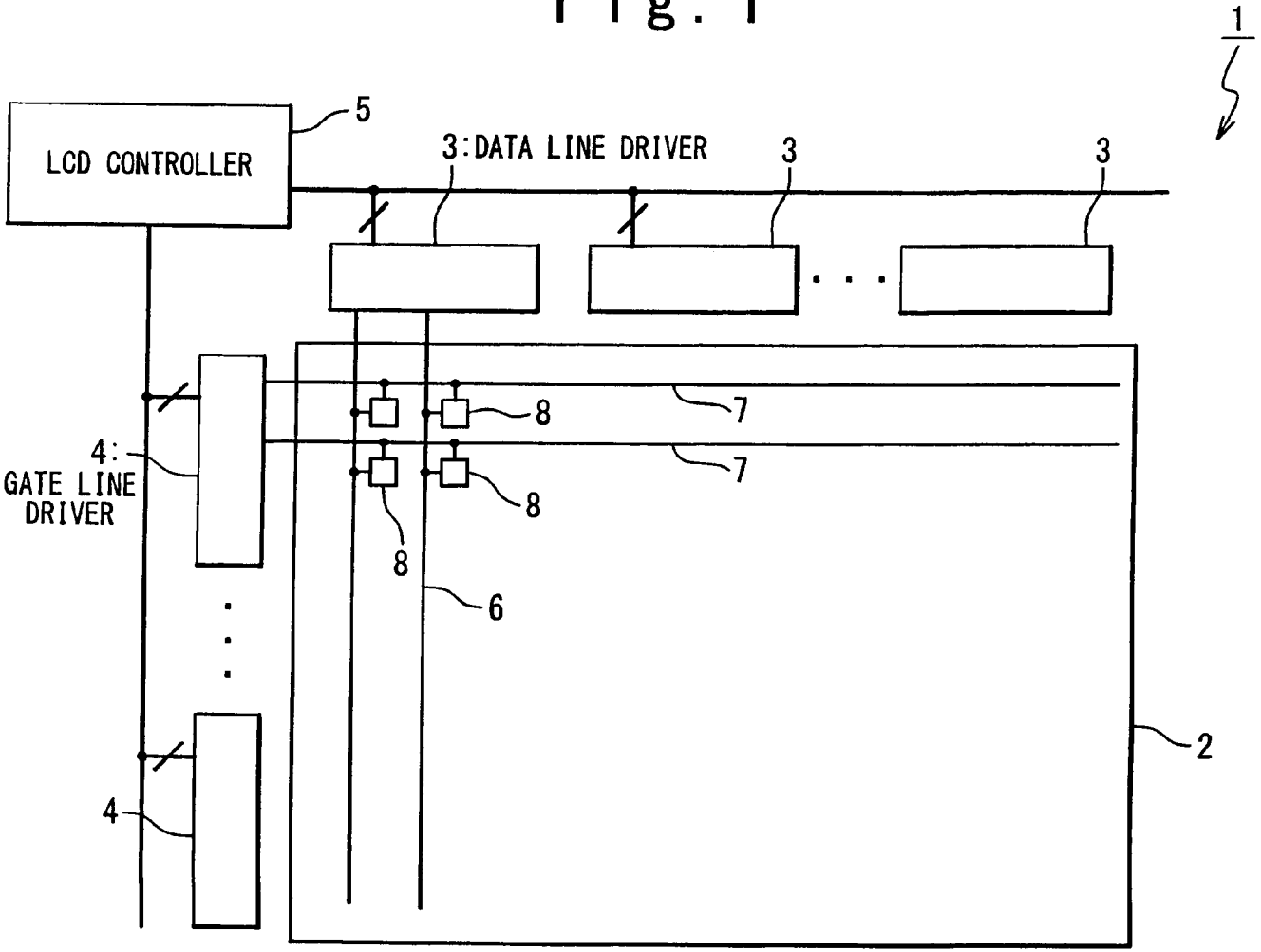
FIG. 1 is a block diagram illustrating a configuration of a liquid crystal display apparatus in one embodiment of the present invention.

FIG. 1 is a block diagram illustrating a configuration of a liquid crystal display apparatus provided with a display panel driver according to one embodiment of the present invention. In the present embodiment, the liquid crystal display apparatus 1 includes a liquid crystal display panel 2, data line drivers 3, gate line drivers 4, and an LCD controller 5. The liquid crystal display panel 2 is provided with data lines 6 and gate lines 7, and further arranged with pixels 8 at positions at which the data lines 6 and gate lines 7 intersect with each other. It should be noted that FIG. 1 only illustrates the two data lines 6, two gate lines 7, and four pixels 8; however, one skilled in the art could be easily understood that more data lines 6, more gate lines 7, and more pixels 8 are actually arranged in the liquid crystal display panel 2. The data line drivers 3 drive the data lines 6 of the liquid crystal display panel 2, and the gate line drivers 4 drive the gate lines 7. The LCD controller 5 controls the data line drivers 3 and the gate line drivers 4.

Figure 2:
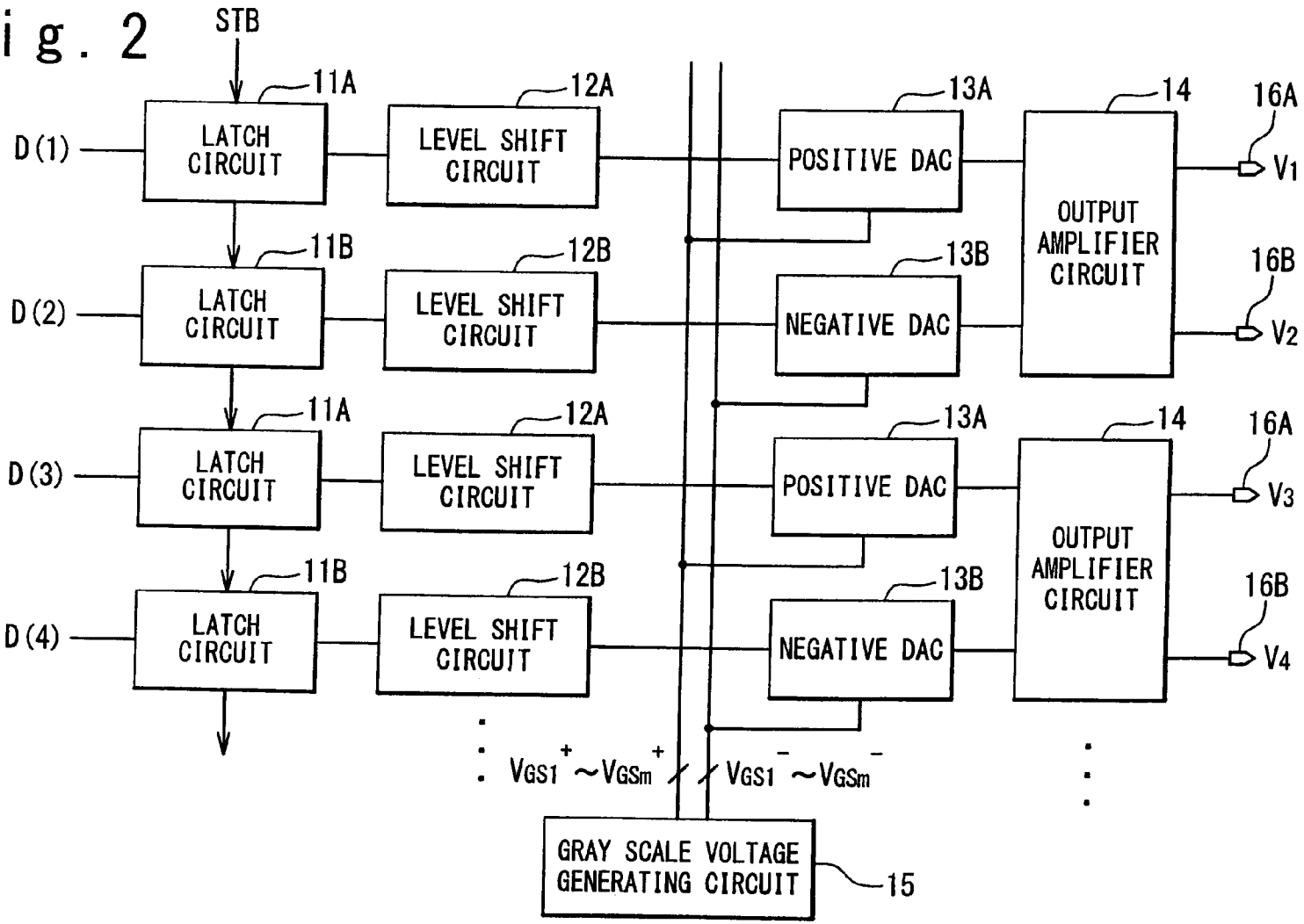
FIG. 2 is a block diagram illustrating a configuration of a data line driver in one embodiment of the present invention.

FIG. 2 is a block diagram schematically illustrating a configuration of the data line driver 3. The data line driver 3 includes latch circuits 11A and 11B, level shift circuits 12A and 12B, positive digital-to-analog converters (DACs) 13A, negative DACs 13B, output amplifier circuits 14, a gray scale voltage generating circuit 15, and output terminals 16A and 16B. The output terminals 16A are connected with odd-numbered data lines 6, and the output terminals 16B are connected with even-numbered data lines 6.

The latch circuits 11A and 11B latch and store image data D(1) to D(n) transmitted from the LCD controller 5. It should be noted that the image data D(2i−1) refers to data that specifies a gray scale level of a pixel to be driven with a "positive" drive voltage, of two adjacent pixels 8 along a gate line 7, and the'image data D(2i) refers to data that specifies a gray scale level of a pixel to be driven with a "negative" drive voltage, of the two adjacent pixels 8. Also, in this specification, a drive voltage higher than a common voltage $V_{COM}$ is referred to as the "positive" drive voltage, and a drive voltage lower than the common voltage $V_{COM}$ is referred to as the "negative" drive voltage. Further, the common voltage $V_{COM}$ refers to a voltage of a counter electrode of the liquid crystal display panel 2, and is set equal to or close to the intermediate power supply voltage VDD/2 that is a half of a power supply voltage VDD.

Operations of the latch circuits 11A and 11B are controlled based on a strobe signal STB, and when the strobe signal STB is asserted, the latch circuits 11A and 11B latch the image data D(1) to D(n). The image data D(1) to D(n) latched by the latch circuits 11A and 11B are respectively transferred to the positive DACs 13A and the negative DACs 13B through the level shift circuits 12A and 12B.

The positive DAC 13A performs digital-to-analog conversion on the image data D(2i−1) (i is a natural number) received from the latch 11A to output a gray scale voltage corresponding to the image data D(2i−1). Specifically, the positive DAC 13A selects the gray scale voltage corresponding to the image data D(2i−1) among gray scale voltages $V_{GS1}^{+}$ to $V_{GSm}^{+}$ received from the gray scale voltage generating circuit 15 to output the selected gray scale voltage. It should be noted that the gray scale voltages $V_{GS1}^{+}$ to $V_{GSm}^{+}$ are determined so as to meet $V_{COM}<V_{GS1}^{+}<V_{GS2}^{+}< \ldots V_{GSm}^{+}<VDD$. As described above, $C_{COM}$ is the common voltage, and VDD is the power supply voltage.

Similarly, the negative DAC 13B performs the digital-analog conversion on the image data D(2i) received from the latch 11B to output a gray scale voltage corresponding to the image data D(2i). Specifically, the negative DAC 13B selects the gray scale voltage corresponding to the image data D(2i) among gray scale voltages $V_{GS1}^{-}$ to $V_{GSm}^{-}$ received from the gray scale voltage generating circuit 15 to output the selected gray scale voltage. It should be noted that the gray scale voltages $V_{GS1}^{-}$ to $V_{GSm}^{-}$ are determined so as to meet $VSS<V_{GSm}^{-}<V_{GSm-1}^{-}< \ldots <V_{GS1}^{-}<V_{COM}$. Here, VSS is the ground voltage (=0 V).

The output amplifier circuit 14 generates drive voltages corresponding to gray scale voltages received from the positive and negative DACs 13A and 13B to output the generated drive voltages to the output terminals 16A and 16B. It should be noted that, in FIG. 2, a drive voltage outputted to an odd-numbered data line 6 is referred to as and a drive voltage outputted to an even-numbered data line 6 is described as $V_{2i}$. One of data lines 6 connected to a pair of output terminals 16A and 16B is supplied with a positive drive voltage, which is higher than the common voltage $V_{COM}$, and the other one is supplied with a negative drive voltage, which is lower than the common voltage $V_{COM}$. If the data lines 6 connected to the output terminals 16A and 16B are respectively driven with positive and negative drive voltages, the positive drive voltage corresponding to the gray scale voltage received from the positive DAC 13A is outputted to the output terminal 16A, and the negative drive voltage corresponding to the gray scale voltage received from the positive DAC 13B is outputted to the output terminal 16B. On the other hand, if the data lines 6 connected to the output terminal 16A and 16B are respectively driven with negative and positive drive voltages, the positive drive voltage corresponding to the gray scale voltage received from the positive DAC 13A is outputted to the output terminal 16B, and the negative drive voltage corresponding to the gray scale voltage received from the negative DAC 13B is outputted to the output terminal 16A.

As described above, recent requirements for the data line driver 3 include a low power consumption amount and a low voltage operation. Therefore, the inventor of the present invention studied the following three methods in order to meet such requirements:

(1) An intermediate power supply voltage VDD/2 that is a half of the power supply voltage VDD is supplied to an output stage of the output amplifier circuit 14 to operate the output amplifier circuit 14 with the power supply voltage VDD, the intermediate power supply voltage VDD/2, and the ground voltage VSS;

(2) Depletion type NMOS transistors are used as a part of NMOS transistors in an output stage of the output amplifier circuit 14, which outputs the positive drive voltage; and (3) PMOS transistors are used, in each of which a well is separated from the other PMOS transistors and a back gate is connected to a source in a part of PMOS transistors in an output stage of the output amplifier circuit 14, which outputs the negative drive voltage.

Figure 3:
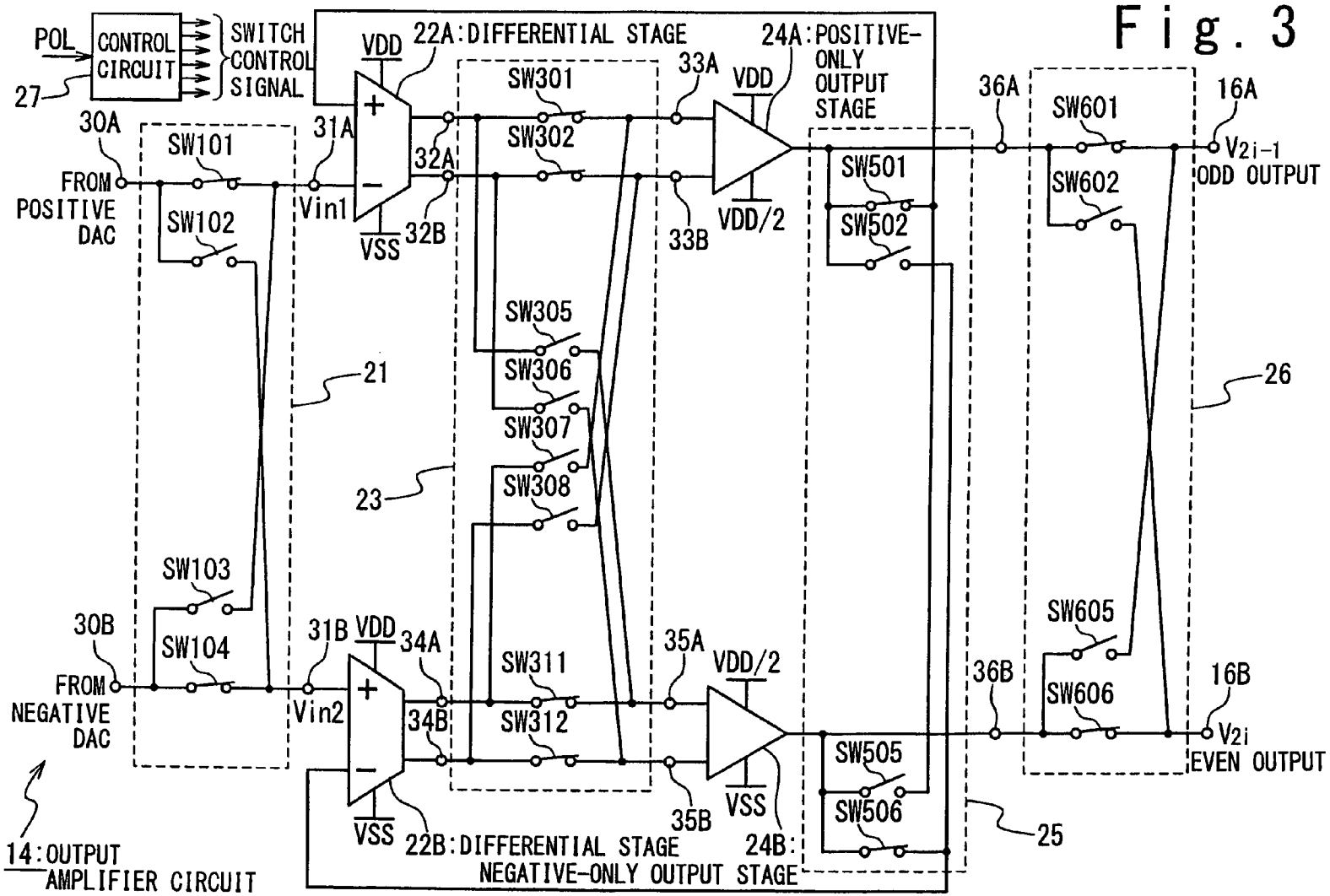
FIG. 3 is a circuit diagram illustrating a configuration of an output amplifier circuit investigated by the inventor of the present invention.

FIG. 3 is a circuit diagram illustrating a configuration of the output amplifier circuit 14 that is a prototype investigated by the inventor of the present invention on the basis of such a technical idea. The output amplifier circuit 14 includes an input side switch circuit 21, differential stages 22A and 22B, an intermediate switch circuit 23, a positive-only output stage 24A, a negative-only output stage 24B, a feedback system switch circuit 25, an output side switch circuit 26, and a control circuit 27. An input node 30A of the output amplifier circuit 14 is connected to an output of the positive DAC 13A, and receives a positive gray scale voltage outputted from the positive DAC 13A. On the other hand, an input node 30B of the output amplifier circuit 14 is connected to an output of the negative DAC 13B, and receives a negative gray scale voltage outputted from the negative DAC 13B.

The input side switch circuit 21 has a function that switches connections between the input nodes 30A and 30B and input nodes 31A and 31B of the differential stages 22A and 22B. In the circuit configuration of FIG. 3, the input side switch circuit 21 includes four switches, i.e., switches SW101 to SW104.

The intermediate switch circuit 23 has a function that switches connections between output nodes of the differential stages 22A and 22B and input nodes of the positive-only and negative-only output stages 24A and 24B. In the circuit configuration of FIG. 3, the intermediate switch circuit 23 includes eight switches, i.e., switches SW301, SW302, SW305 to SW 308, SW311, and SW312.

The feedback system switch circuit 25 has a Junction that switches connection between output nodes of the positive-only and negative-only output stages 24A and 24B and the input nodes 36A and 36B of the output side switch circuit 26. In the circuit configuration of FIG. 3, the feedback system switch circuit 25 includes four switches, i.e., switches SW501, SW502, SW505, and SW506. The feedback system switch circuit 25 has a role to switch a feedback destination of output voltages of the positive-only and negative-only output stages 24A and 24B to any of the differential stages 22A and 22B.

Further, the output side switch circuit 26 has a function that switches connections between the output nodes of the positive-only and negative-only output stages 24A and 24B and the output terminals 16A and 16B of the output amplifier circuit 14. In the circuit configuration of FIG. 3, the output side switch circuit 26 includes switches SW601, SW602, SW605, and SW606.

The control circuit 27 controls on/off of each of the switches in the input side switch circuit 21, the intermediate switch circuit 23, the feedback system switch circuit 25, and the output side switch circuit 26 in response to a polarity signal POL. It should be noted that the polarity signal POL refers to a signal that specifies polarities of the drive voltages outputted from the respective output terminals 16A and 16B. In one embodiment, if the polarity signal POL is in a High level, each of the switches is controlled to output the positive and negative drive voltages from the output terminals 16A and 16B, respectively, whereas if the polarity signal POL is in a Low level, each of the switches is controlled to output the negative and positive drive voltages from the output terminals 16A and 16B, respectively.

Figure 4:
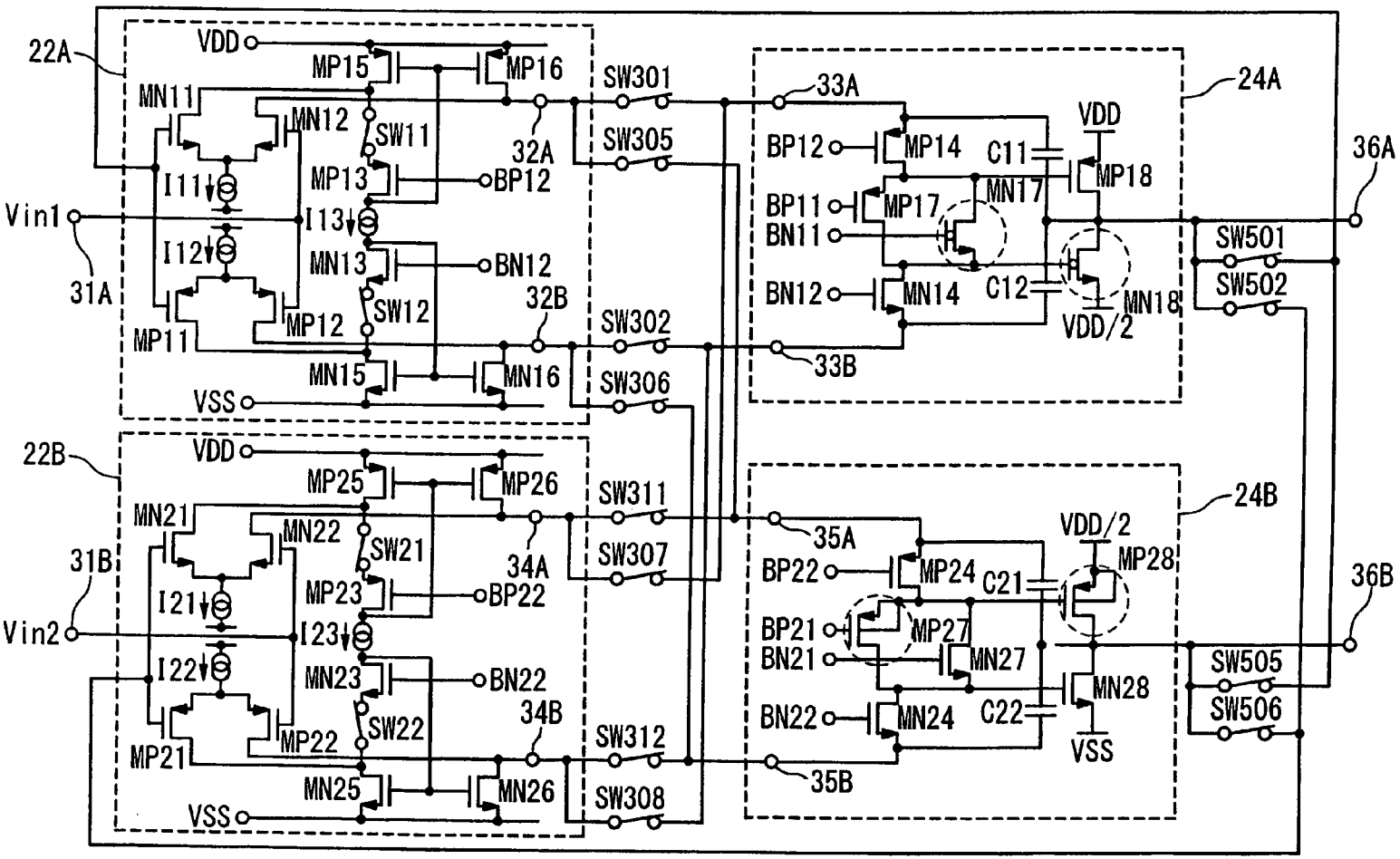
FIG. 4 is a circuit diagram illustrating configurations of differential stages and positive and negative-only output stages of the output amplifier circuit in FIG. 3.

FIG. 4 is a diagram specifically illustrating configuration of the differential stages 22A and 22B, and the positive-only and negative-only output stages 24A and 24B of the output amplifier circuit 14. The differential stage 22A has a Rail-to-Rail configuration, i.e., a configuration that can deal with an input voltage in a range of voltage equal to or more than the ground voltage VSS and equal to or less than the power supply voltage VDD. Specifically, the differential stage 22A includes NMOS transistors MN11 to MN13, MN15, and MN16, PMOS transistors MP11 to MP13, MP15, and MP16, constant current sources I11 and I12, and switches SW11 and SW12. It should be noted that symbols "BP12" and "BN12" denote bias voltages supplied to gates of the PMOS transistor MP13 and NMOS transistor MN13, respectively. The differential stage 22A outputs voltages corresponding to a voltage at the input node 31A to output nodes 32A and 32B.

It should be noted that the switch SW11 is a switch that is inserted as a dummy switch for the switches SW301 and SW305 in order to symmetrize operating conditions of the NMOS transistor MN11 and PMOS transistor MP15 and operating conditions of the NMOS transistor MN12 and PMOSX transistor MP16, and constantly switched on. For example, if the switch SW11 is absent, there arises a difference between drain voltages of the PMOS transistors MP15 and MP16, which may cause the occurrence of an offset voltage of the output amplifier circuit 14. The switch SW11 is used to solve such a problem. Similarly, the switch SW12 is also a switch inserted as a dummy switch for the switches SW302 and SW306, and constantly switched on.

The differential stage 22B also has the Rail-to-Rail configuration, i.e., a configuration that can deal with an input voltage in a range of voltage equal to or more than the ground voltage VSS and equal to or less than the power supply voltage VDD. Specifically, the differential stage 22B includes NMOS transistors MN21 to MN23, MN25, and MN26, PMOS transistors MP21 to MP23, MP25, and MP26, constant current sources I21 and I22, and switches SW21 and SW22. It should be noted that symbols "BP22" and "BN22" denote bias voltages supplied to gates of the PMOS transistor MP23 and NMOS transistor MN23, respectively. The switch SW 21 is a switch inserted as a dummy switch for the switches SW307 and SW311, and constantly switched on. Similarly, the switch 22 is a switch inserted as a dummy switch for the switches SW308 and SW312, and always switched on.

The positive-only output stage 24A is configured to be able to output a desired positive drive voltage (i.e., drive voltage equal to or more than $V_{GS1}^{+}$ and equal to or less than $V_{GSm}^{+}$) in response to voltages at the input nodes 33A and 33B. The positive-only output stage 24A is supplied with the intermediate power supply voltage VDD/2 and the power supply voltage VDD, and operates in the intermediate power supply voltage VDD/2 and the power supply voltage VDD.

In the configuration of FIG. 4, the positive-only output stage 24A includes NMOS transistors MN14, MN17, and MN18, PMOS transistors MP14, MP17, and MP18, and capacitors C11 and C12. It should be noted that symbols "BP11" and "BP12" respectively refer to bias voltages supplied to gates of the PMOS transistors MP17 and MP14, and "BN11" and "BN12" respectively refer to bias voltages supplied to gates of the NMOS transistors MN17 and MN14. Also, it should be noted that the PMOS transistor MP14 of the positive-only output stage 24A and the PMOS transistor MP13 of the differential stage 22A are supplied with the same bias voltage BP12, and the NMOS transistor MN14 of the positive-only output stage 24A and the NMOS transistor MN13 of the differential stage 22A are supplied with the same bias voltage BN12.

In the positive-only output stage 24A, the PMOS transistor MP18 is an output transistor for pulling up an output node 36A, and the NMOS transistor MN18 is an output transistor for pulling down the output node 36A. Also, the PMOS transistor MP17 and the NMOS transistor MN17 form a two-terminal floating current source with a source of one of them being connected to a drain of the other one. One of terminals of the floating current source is connected to a gate of the PMOS transistor MP18, and the other terminal is connected to a gate of the NMOS transistor MN18. A voltage at the output node 36A is determined based on a voltage between the both terminals of the floating current source formed from the NMOS transistor MN17 and the PMOS transistor MP17. Also, the capacitors C11 and C12 are phase compensation capacitors for compensating a phase of the drive voltage outputted from the output node 36A.

On the other hand, the negative-only output stage 24B is configured to be able to output a desired negative drive voltage (i.e., drive voltage equal to or more than $V_{GSm}^{-}$ and equal to or less than $V_{GS1}^{-}$) in response to voltages at the input nodes 35A and 35B. The negative-only output stage 24B is supplied with the ground voltage VSS and the intermediate power supply voltage VDD/2, and operates with the ground voltage VSS and the intermediate power supply voltage VDD/2.

In the configuration of FIG. 4, the negative-only output stage 24B includes NMOS transistors MN24, MN27, and MN28, PMOS transistors MP24, MP27, and MP28, and capacitors C21 and C22. It should be noted that symbols "BP21" and "BP22" respectively refer to bias voltages supplied to gates of the PMOS transistors MP27 and MP24, and "BN21" and "BN22" respectively refer to bias voltages supplied to gates of the NMOS transistors MN27 and MN24. Also, it should be noted that the PMOS transistor MP24 of the negative-only output stage 24B and the PMOS transistor MP23 of the differential stage 22B are supplied with the same bias voltage BP22, and the PMOS transistor MN24 of the negative-only output stage 24B and the NMOS transistor MN23 of the differential stage 22B are supplied with the same bias voltage BN22.

In the negative-only output stage 24B, the PMOS transistor MP28 is an output transistor for pulling up an output node 36B, and the NMOS transistor MN28 is an output transistor for pulling down the output node 36B. Also, the NMOS transistor MN27 and the PMOS transistor MP27 form a two-terminal floating current source with a source of one of them being connected to a drain of the other one. One of terminals of the floating current source is connected to a gate of the PMOS transistor MP28, and the other terminal is connected to a gate of the NMOS transistor MN28. A voltage at the output node 36B is determined based on a voltage between the both terminals of the floating current source formed from the NMOS transistor MN27 and the PMOS transistor MP27. Also, the capacitors C21 and C22 are phase compensation capacitors for compensating a phase of the drive voltage outputted from the output node 36B.

An operation of the output amplifier circuit illustrated in FIGS. 3 and 4 is schematically as follows. That is, the output amplifier circuit 14 outputs the positive drive voltage to one of the output terminals 16A and 16B, and the negative drive voltage to the other terminal. Polarities of the drive voltages respectively outputted to the output terminals 16A and 16B are switched to each other every predetermined horizontal period (e.g., every one horizontal period) in response to the polarity signal POL. If the polarities of the drive voltages are switched to each other every one horizontal period, dot inversion driving is performed.

When the positive drive voltage is outputted to the output terminal 16A, and the negative drive voltage is outputted to the output terminal 16B (i.e., when the positive drive voltage is outputted to an odd-numbered data line 6, and the negative drive voltage is outputted to an even-numbered data line), the output node 36A of the positive-only output stage 24A is connected to the output terminal 16A, and the output node 36B of the negative-only output stage 24B is connected to the output terminal 16B. In this case, the output amplifier circuit 14 of FIG. 3 operates as a voltage follower that outputs to the output terminal 16A, a same drive voltage as the positive gray scale voltage supplied to the input node 30A from the positive DAC 13A, and outputs to the output terminal 16B, a same drive voltage as the negative gray scale voltage supplied to the input node 30B from the negative DAC 13B.

On the other hand, when the negative drive voltage is outputted to the output terminal 16A, and the positive drive voltage is outputted to the output terminal 16B (i.e., when the negative drive voltage is outputted to an odd-numbered data line 6, and the positive drive voltage is outputted to an even-numbered data line), the output node 36A of the positive-only output stage 24A is connected to the output terminal 16B, and the output node 36B of the negative-only output stage 24B is connected to the output terminal 16A. In this case, the output amplifier circuit 14 of FIG. 3 operates as a voltage follower that outputs to the output terminal 16B, a same drive voltage as the positive gray scale voltage supplied to the input node 30A from the positive DAC 13A, and outputs to the output terminal 16A, a same drive voltage as the negative gray scale voltage supplied to the input node 30B from the negative DAC 13B.

At this time, to reduce an amplitude difference deviation of the output amplifier circuit 14, the connections among the input nodes 30A and 30B, the differential stages 22A and 22B, and the positive-only and negative-only output stages 24A and 24B are switched in appropriate periods. It should be noted that the "amplitude difference deviation" refers to as a difference between absolute values of the positive drive voltage and negative drive voltage when gray scale values of image data are the same. In addition, the absolute values of the drive voltages are defined with respect to the common voltage $V_{COM}$. That is, it should be noted that the absolute values of the drive voltages mean absolute values of differences between the drive voltages and the common voltage $V_{COM}$. In one embodiment, the following two connection states (A) and (B) are alternately repeated in the appropriate periods, and thereby an amplitude difference deviation of the output amplifier circuit 14 is reduced:

Connection State (A):

In the connection state (A), the input node 30A is connected to the input node 31A (inversion input) of the differential stage 22A; the output nodes 32A and 32B of the differential stage 22A are connected to the input nodes 33A and 33B of the positive-only output stage 24A; and the output node 36A of the positive-only output stage 24A is connected to a non-inversion input of the differential stage 22A. Also, the input node 30B is connected to the input node 31B (non-inversion input) of the differential stage 22B; the output nodes 34A and 34B of the differential stage 22B are connected to the input nodes 35A and 35B of the negative-only output stage 24B; and the output node 36B of the negative-only output stage 24B is connected to an inversion input of the differential stage 22B.

Connection State (B):

On the other hand, in the connection state (B), the input node 30A is connected to the input node 31B (non-inversion input) of the differential stage 22B; the output nodes 34A and 34B of the differential stage 22B are connected to the input nodes 33A and 33B of the positive-only output stage 24A;

and the output node 36A of the positive-only output stage 24A is connected to the inversion input of the differential stage 22B. Also, the input node 30B is connected to the input node 31A (inversion input) of the differential stage 22A; the output nodes 32A and 32B of the differential stage 22A are connected to the input nodes 35A and 35B of the negative-only output stage 24B; and the output node 36B of the negative-only output stage 24B is connected to the non-inversion input of the differential stage 22A.

It should be noted that in any of the connection states (A) and (B), the positive drive voltage that is supplied to the input node 30A and corresponds to the positive gray scale voltage is outputted to the output node 36A of the positive-only output stage 24A, and the negative drive voltage that is supplied to the input node 30B and corresponds to the negative gray scale voltage is outputted to the output node 36B of the negative-only output stage 24B. In one embodiment, the above-described connection states (A) and (B) are switched to each other every two horizontal periods.

According to such an operation, the amplitude difference deviation of the output amplifier circuit 14 can be reduced. For example, it is assumed that an offset voltage of the differential stage 22A is $+\alpha$, an offset voltage of the differential stage 22B is $+\beta$, an expectation of the positive drive voltage is Vp, and an expectation of the negative drive voltage is Vn. When the differential stage 22A is always connected to the positive-only output stage 24A, and the differential stage 22B is always connected to the negative-only output stage 24B, the amplitude difference deviation $\Delta V_{AMP}$ is calculated by the following equation (1):

$$\begin{aligned}\Delta V_{AMP} &= (Vp+\alpha)-(Vn+\beta) \\ &= (Vp-Vn)-(\alpha+\beta)\end{aligned} \tag{1}$$

On the other hand, as described above, when the connections among the input nodes 30A and 30B, the differential stages 22A and 22B, and the positive-only and negative-only output stages 24A and 24B are switched, an amplitude difference deviation $\Delta V_{AMP_A}$ at the output terminal 16A is calculated by the following equation (2A):

$$\begin{aligned}\Delta V_{AMP_A} &= (Vp+\alpha)-(Vn+\alpha) \\ &= (Vp-Vn)\end{aligned} \tag{2A}$$

It should be noted that for generation of the drive voltage from the output terminal 16A, only the differential stage 22A is used, but the differential stage 22B is not used.

Similarly, an amplitude difference deviation $\Delta V_{AMP_B}$ at the output terminal 16B is calculated by use of the following equation (2B):

$$\begin{aligned}\Delta V_{AMP_B} &= (Vp+\beta)-(Vn+\beta) \\ &= (Vp-Vn)\end{aligned} \tag{2B}$$

It should be noted that for generation of the drive voltage from the output terminal 16B, only the differential stage 22B is used, but the differential stage 22A is not used.

It could be understood from the comparisons between the equation (1) and the equations (2A) and (2B) that the amplitude difference deviation of the output amplifier circuit 14 can be reduced by switching the connections among the input nodes 30A and 30B, the differential stages 22A and 22B, and the positive-only and negative-only output stages 24A and 24B.

In the output amplifier circuit 14 illustrated in FIGS. 3 and 4, a low voltage operation is achieved by the following four approaches:

(1) As the NMOS transistor MN18 that is the output transistor for pulling down the output node 36A of the positive-only output stage 24A, a depletion type transistor is used.

(2) As the NMOS transistor MN17 of the floating current source of the positive-only output stage 24A, a depletion type transistor is used.

(3) As the PMOS transistor MP28 that is the output transistor for pulling up the output node 36A of the negative-only output stage 24B, a PMOS transistor is used, in which a well is separated from the other PMOS transistors and a back gate is connected to a source.

(4) As the PMOS transistor MP27 of the floating current source of the negative-only output stage 24B, a PMOS transistor is used, in which a well is separated from the other PMOS transistors and a back gate is connected to a source.

It should be noted that, in the configuration of FIG. 4, the back gates of the PMOS transistors MP27 and MP28 are not supplied with the power supply voltage VDD. Also, it should be noted that the two depletion type NMOS transistors, and two PMOS transistors, in each of which the well is separated from the other PMOS transistors and the back gate is connected to the source, are illustrated so as to be emphasized by dashed line circles.

By using the depletion type transistors as the NMOS transistors MN17 and MN18, gate-source voltages of the NMOS transistors MN17 and MN18 can be reduced to allow the positive-only output stage 24A to be operated at a low voltage. In addition, by using as the PMOS transistors MP27 and MP28, the PMOS transistors, in each of which the well is separated from the other PMOS transistors and the back gate is connected to the source, gate-source voltages (absolute values) of the PMOS transistors MN27 and MN28 can be reduced to allow the negative-only output stage 24B to be operated at the low voltage.

The above-described output amplifier circuit 14 having the configuration illustrated in FIGS. 3 and 4 is preferable for achieving the low voltage operation, but has the following two problems:

The first problem is in that it is indispensable to supply the intermediate power supply voltage VDD/2 to the positive voltage output stage 24A, from the viewpoint of a circuit operation. As described above, the end manufacturers of the liquid crystal display apparatuses may desire the operation only by the power supply voltage VDD and the ground voltage VSS; however, the configuration illustrated in FIGS. 3 and 4 cannot meet such a requirement.

Figure 5A:
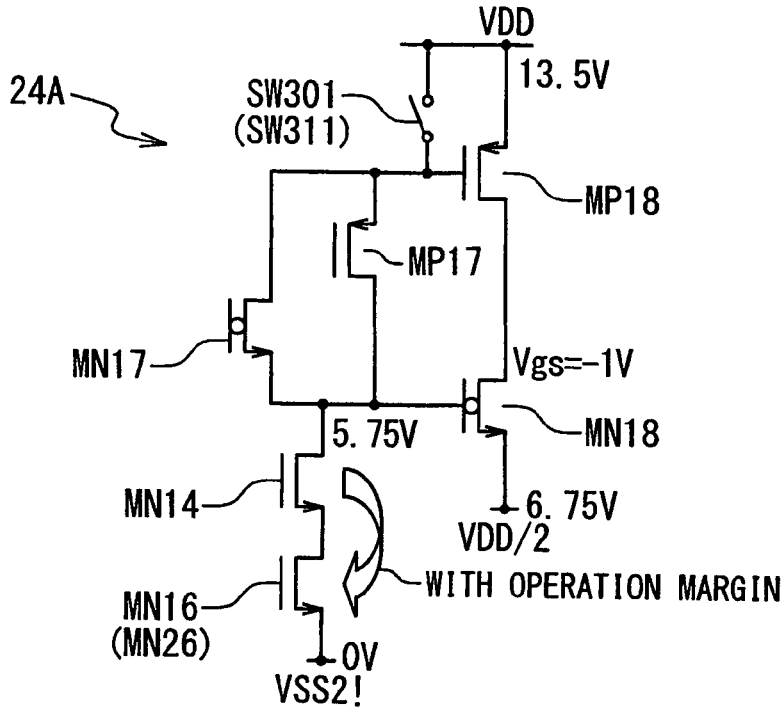
FIG. 5A is a circuit diagram for describing a problem in the positive-only output stage of the output amplifier circuit in FIGS. 3 and 4.
Figure 5B:
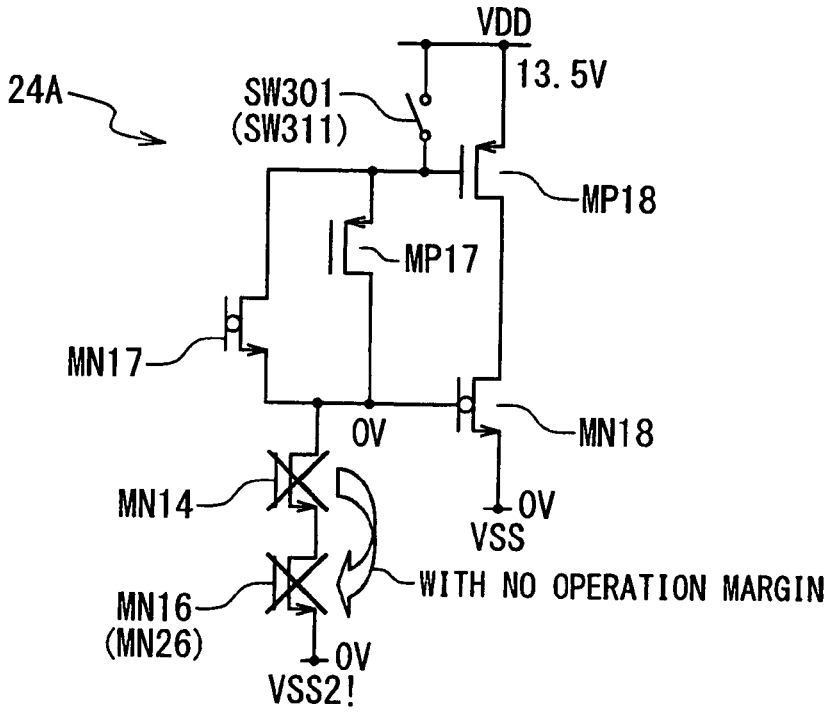
FIG. 5B is a circuit diagram for describing the problem in the positive-only output stage of the output amplifier circuit in FIGS. 3 and 4.

Specifically, there arises a problem that if the ground voltage VSS is supplied, instead of the intermediate power supply voltage VDD/2, to a source of the NMOS transistor MN18 of the positive voltage output stage 24A, an operation margin of the NMOS transistor that pulls downs the voltage of a gate of the NMOS transistor MN18 will be insufficient. FIGS. 5A and 5B are diagrams illustrating the problem.

FIG. 5A is a conceptual diagram illustrating voltage levels at respective nodes of the positive voltage output stage 24A when the source of the NMOS transistor MN18 is supplied with the intermediate power supply voltage VDD/2. FIG. 5A illustrates the case where the power supply voltage is 13.5 V, and the intermediate power supply voltage VDD/2 is 6.75 V.

In the output amplifier circuit 14 illustrated in FIGS. 3 and 4, the NMOS transistor MN14 of the positive-only output stage 24A, the NMOS transistor MN16 of the differential stage 22A, and the NMOS transistor MN26 of the differential stages 22B are used to pull down the gate voltage of the NMOS transistor MN18. It should be noted that the NMOS transistor MN16 of the differential stage 22A, or the NMOS transistor MN26 of the differential stages 22B is exclusively used depending on the connections between the positive-only output stage 24A and the differential stage 22A or 22B When the source of the NMOS transistor MN18 is supplied with the intermediate power supply voltage VDD/2, a voltage of the gate of the NMOS transistor MN18 is high enough to operate the NMOS transistors MN14 and MN16 (or MN26). For example, in the example of FIG. 5A, the gate voltage of the NMOS transistor NM18 is 5.75 V.

On the other hand, when the source of the NMOS transistor MN18 is supplied with the ground voltage VSS, the gate voltage of the NMOS transistor MN18 is not enough to operate the NMOS transistors NM14 and MN16 (or MN26). For example, in the example of FIG. 5B, the gate voltage of the NMOS transistor MN18 is 0 V. This means that, in the output amplifier circuit 14 having the configuration of FIGS. 3 and 4, it is indispensable to supply the intermediate power supply voltage VDD/2 to the positive voltage output stage 24A.

The second problem of the output amplifier 14 illustrated in FIGS. 3 and 4 is in that if the polarities of the drive voltages respectively outputted from the output terminals 16A and 16B are inverted in the state that the intermediate power supply voltage VDD/2 is supplied to the negative-only output stage 24B, a parasitic PNP transistor of the PMOS transistor MP28 in the negative power output stage 24B may be turned on. It should be noted that the PMOS transistor MP28 the well is separated from the other PMOS transistors and the back gate is connected to the source.

Figure 6A:
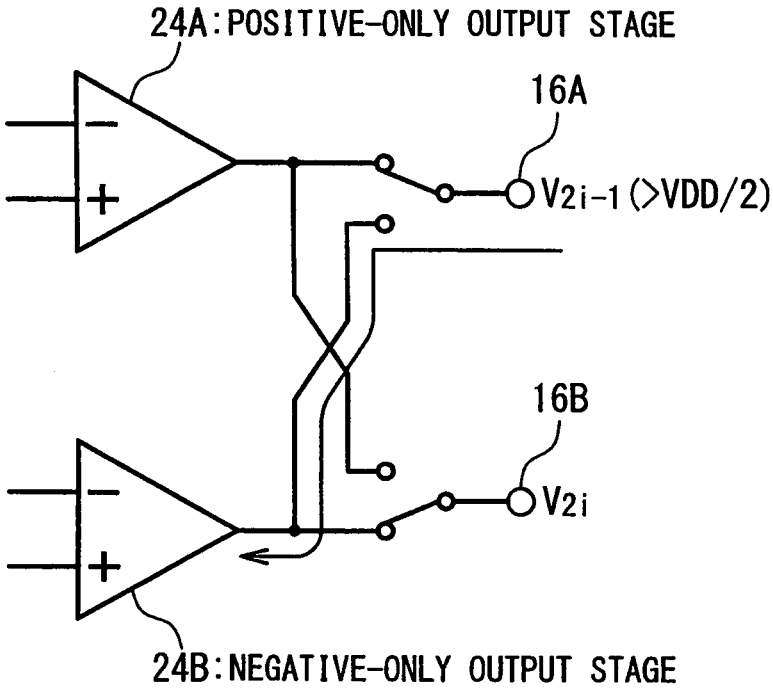
FIG. 6A is a circuit diagram for describing a problem in the negative-only output stage of the output amplifier circuit in FIGS. 3 and 4.
Figure 6B:
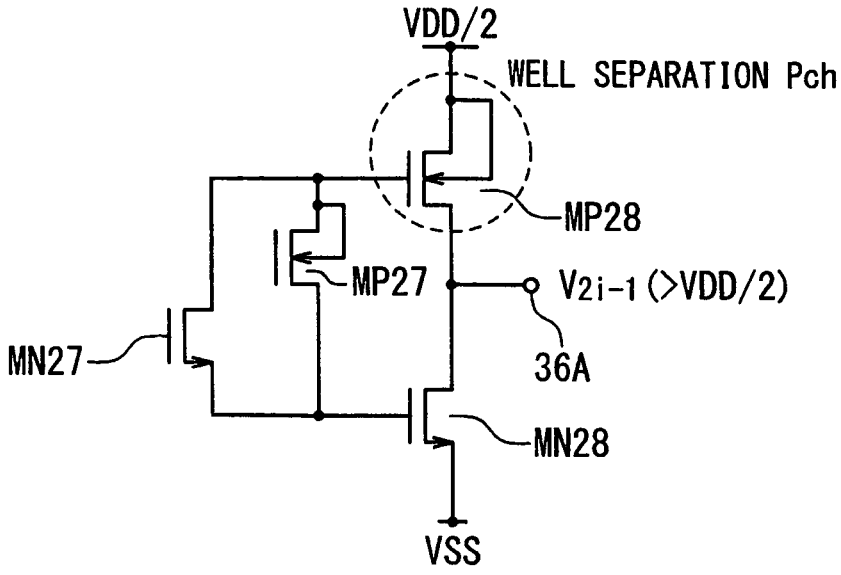
FIG. 6B is a circuit diagram for describing the problem in the negative-only output stage of the output amplifier circuit in FIGS. 3 and 4.
Figure 6C:
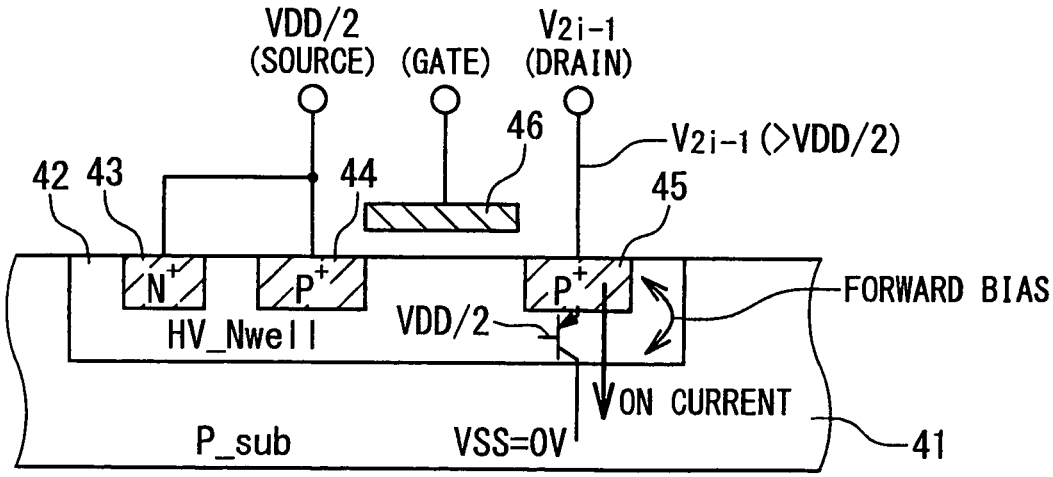
FIG. 6C is a circuit diagram for describing the problem in the negative-only output stage of the output amplifier circuit in FIGS. 3 and 4.

The problem that the parasitic PNP transistor is turned on will be described in detail. As illustrated in FIG. 6A, for example, when the output terminal 16A is driven with the positive drive voltage $V_{2i-1}$ (>VDD/2) and then switched to the negative drive voltage, the output node of the negative-only output stage 24B is applied with a higher voltage than the intermediate power supply voltage VDD/2 at a moment when the output terminal 16A is connected to the output node of the negative-only output stage 24B. In this case, as illustrated in FIG. 6B, a drain of the PMOS transistor MP28 is applied with the higher voltage (drive voltage $V_{2i-1}$) than the intermediate power supply voltage VDD/2 in the state that the intermediate power supply voltage VDD/2 is supplied to the source and the back gate of the PMOS transistor MP28. FIG. 6C is a cross-sectional view illustrating a state of the PMOS transistor MP28 when such a bias is applied. In FIG. 6C, a reference numeral 41 denotes a P-type substrate; a reference numeral 42 an N well; a reference numeral 43 an $N^+$-type well contact region; a reference numeral 44 a $P^+$-type source region; a reference numeral 45 a $P^+$-type drain region; and a reference numeral 46 a gate. The superscript "+", a character added to the upper right, in FIG. 6C and this specification means heavy doping.

As illustrated in FIG. 6C, if the drain of the PMOS transistor MP28 is applied with the higher voltage than the intermediate power supply voltage VDD/2, a forward bias may be applied between a base and an emitter of the parasitic PNP transistor formed by the P-type substrate 41, the N well 42, and the drain region 45 to turn on the parasitic PNP transistor. The turning-on of the parasitic PNP transistor is not preferable because a failure such as latch-up may occur in the operation of the output amplifier circuit 14.

The inventor has considered as various solutions for addressing the above two problems as follows: First, regarding the problem in the positive-only output stage 24A, a solution is considered in which if the intermediate power supply voltage VDD/2 is supplied, the positive-only output stage 24A is used, whereas if the intermediate power supply voltage VDD/2 is not supplied, the NMOS transistor of a depletion type is not used as the output transistor, but a separately prepared output stage is used.

On the other hand, regarding the problem in the negative-only output stage 24B, a solution is considered in which a separately prepared output stage is used that is configured such that when the output terminal 16A or 16B is switched from the positive drive voltage to the negative drive voltage with the intermediate power supply voltage VDD/2 being supplied, the PMOS transistor of which the well is separated from the other PMOS transistors and the back gate is connected to the source is not used. After the output terminal 16A or 16B has been driven with the negative drive voltage once, the negative-only output stage 24B may be used to keep a voltage level of the output terminal 16A or 16B (and a voltage level of a data line 6 connected to it).

One discovery by the inventor is in that the above-described two solutions can be achieved through use of a single output stage. That is, the problem in the positive-only output stage 24A using the depletion type NMOS transistor as the output transistor arises when the intermediate power supply voltage VDD/2 is not supplied, and the positive-only output stage 24A operates by use of only the power supply voltage VDD and the ground voltage. On the other hand, the problem in the negative-only output stage 24B using the PMOS transistor of which the well is separated from the other PMOS transistors and the back gate is connected to the source arises only when the intermediate power supply voltage VDD/2 is used to operate the negative-only output stage 24B. Accordingly, if one output stage using only normal NMOS and PMOS transistors is separately prepared, the above two problems can be solved at a same time.

FIG. 7 is a diagram illustrating the configuration of the output amplifier circuit 14 intended to address the above two problems at the same time. Differences of the output amplifier circuit 14 of FIG. 7 from that 14 of FIG. 2 are as follows:

(1) The output amplifier circuit 14 of FIG. 7 additionally includes a common output stage 28;

(2) The intermediate switch circuit 23 additionally includes switches SW303, SW304, SW309, and SW310;

(3) The feedback system switch circuit 25 additionally includes switches SW503 and SW504;

(4) The output side switch circuit 26 additionally includes switches SW603 and SW604; and (5) The control circuit 27 is supplied with a positive-only output stage selection signal POS_EN, negative-only output stage selection signal NEG_EN, and a common output stage selection signal FULL_EN.

It should be noted that the positive-only output stage selection signal POS_EN refers to a signal that allows the positive-only output stage 24A to operate, and the negative-only output stage selection signal NEG_EN refers to a signal that selects the negative-only output stage 24B. The common output stage selection signal FULL_EN refers to a signal that selects the common output stage 28. The control circuit 27 controls the respective switches of the intermediate switch circuit 23, the feedback system switch circuit 25, and the output side switch circuit 26 in response to the positive-only output stage selection signal POS_EN, the negative-only output stage selection signal NEG_EN, and the common output stage selection signal FULL_EN.

Figure 8:
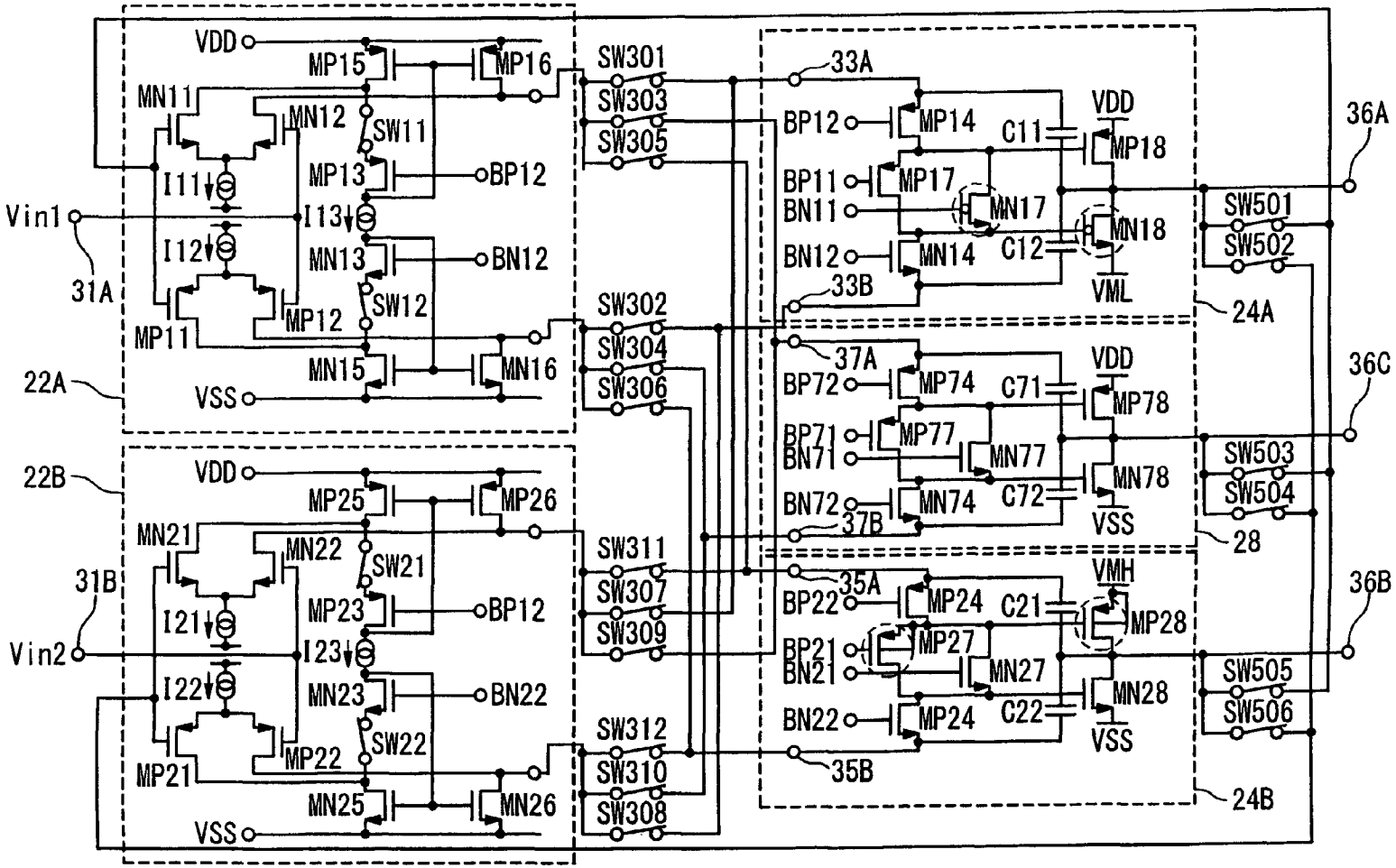
FIG. 8 is a circuit diagram illustrating configurations of differential stages, positive and negative-only output stages, and positive-negative shared output stage of the output amplifier circuit in FIG. 7.

FIG. 8 is a circuit diagram illustrating a configuration of the differential stages 22A and 22B, the positive-only and negative-only output stages 24A and 24B, and the common output stage 28 in the output amplifier circuit 14 of FIG. 7. The configuration of the differential stages 22A and 22B and the positive-only and negative-only output stages 24A and 24B are the same between the output amplifier circuits 14 of FIGS. 7 and 2. It should be noted that in FIGS. 7 and 8, the voltage supplied to the source of the NMOS transistor MN18 of the positive-only output stage 24A is referred to as a voltage VML, and the voltage supplied to the source of the PMOS transistor MP28 of the negative-only output stage 24B is referred to as a voltage VMH.

The common output stage 28 includes NMOS transistors MN74, MN77, and MN78, PMOS transistors MP74, MP77, and MP78, and capacitors C71 and C72. In FIG. 8, symbols "BP71", "BP72", "BN71", and "BN72" respectively denote bias voltages supplied to the PMOS transistors MP77 and MP74 and the NMOS transistors MN77 and MN74. What should be noted is in that as the NMOS transistor MN78, which is an output transistor of the common output stage 28, a normal NMOS transistor (i.e., an enhancement-type NMOS transistor) is used, and that a source (and a back gate) of the PMOS transistor MP78 is supplied with the power supply voltage VDD. The common output stage 28 operates under the supply of the power supply voltage VDD and ground voltage VSS. Also, the capacitors C71 and C72 are phase compensation capacitors for compensating a phase of a drive voltage outputted from the output node 36A.

Input nodes 37A and 37B of the common output stage 28 can be connected to any of the output nodes 32A and 32B of the differential stage 22A or the output nodes 34A and 34B of the differential stage 22B through the intermediate switch circuit 23. On the other hand, an output node 36C of the common output node 28 can be connected to any of the non-inversion input of the differential stage 22A and the inversion input of the differential stage 22B through the feedback system switch circuit 25, and to any of the output terminals 16A and 16B through the output side switch circuit 26.

Figures 9, 10:
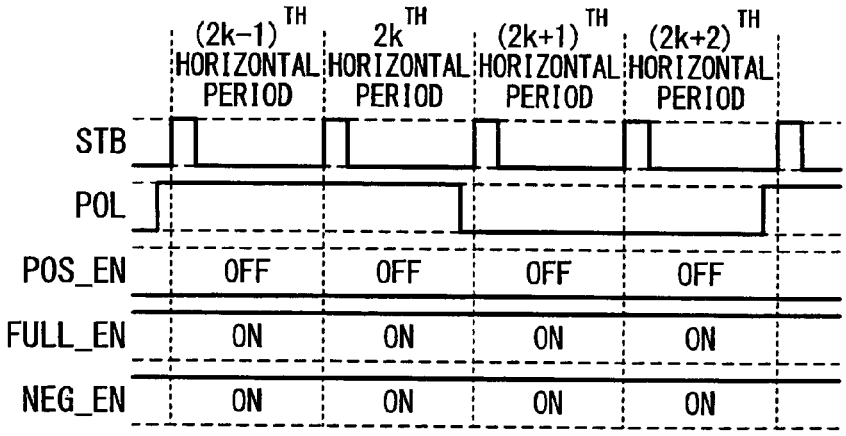
FIG. 9 is a table illustrating an operation of an output amplifier circuit in one embodiment of the present invention.
FIG. 10 is a timing chart illustrating an operation of the output amplifier circuit for the case of full VDD mode setting in one embodiment of the present invention.

Subsequently, the operation of the output amplifier circuit 14 of FIGS. 7 and 8 will be described. FIG. 9 is a table illustrating an outline of the operation of the output amplifier circuit 14 in FIGS. 7 and 8. The output amplifier circuit 14 of FIGS. 7 and 8 has two operation modes, i.e., a full VDD mode and a half VDD mode. The full VDD mode is a mode in which the output amplifier circuit 14 is operated with the power supply voltage VDD and the ground voltage VSS without use of the intermediate power supply voltage VDD/2. On the other hand, the half VDD mode is a mode in which the output amplifier circuit 14 is operated with use of the intermediate power supply voltage VDD/2 in addition to the power supply voltage VDD and the ground voltage VSS. When the output amplifier circuit 14 is set to the full VDD mode, the voltage VML supplied to the positive-only output stage 24A is set to the ground voltage VSS, and the voltage VMH supplied to the negative-only output stage 24B is set to the power supply voltage VDD. On the other hand, when the output amplifier circuit 14 is set to the half VDD mode, the voltage VML supplied to the positive-only output stage 24A and the voltage VMH supplied to the negative-only output stage 24B are both set to the intermediate power supply voltage VDD/2. The operation of the output amplifier circuit 14 in each of the full and half modes will be described.

(Operation in Full VDD Mode)

As illustrated in FIG. 9, when the output amplifier circuit 14 is set to the full VDD mode, the common output stage 28 is used to output the positive drive voltage (drive voltage higher than the common voltage $V_{COM}$), and the negative-only output stage 24B is used to output the negative drive voltage (drive voltage lower than the common voltage $V_{COM}$). Specifically, as illustrated in FIG. 10, in the full VDD mode, the positive-only output stage selection signal POS_EN is negated, and the negative-only output stage selection signal NEG_EN and the common output stage selection signal FULL_EN are asserted. It should be noted that, in FIG. 10, a negated state is illustrated as "OFF" and an asserted state as "ON". In response to the positive-only output stage selection signal POS_EN, the negative-only output stage selection signal NEG_EN, and the common output stage selection signal FULL_EN in addition to the polarity signal POL, the connections among the differential stages 22A and 22B, the positive-only and negative-only output stages 24A and 24B, and the output terminals 16A and 16B are controlled.

The operation of the output amplifier circuit 14 in FIGS. 7 and 8 for this case is the same as that of the output amplifier circuit 14 in FIGS. 3 and 4, except that, instead of the positive-only output stage 24A, the common output stage 28 is used. Specifically, when the positive drive voltage is outputted to the output terminal 16A and the negative drive voltage is outputted to the output terminal 16B, the output node 36C of the common output stage 28 is connected to the output terminal 16A, and the output node 36B of the negative-only output stage 24B is connected to the output terminal 16B. In this case, the output amplifier circuit 14 of FIGS. 7 and 8 operates as a voltage follower that outputs to the output terminal 16A, a same drive voltage as the positive gray scale voltage supplied to the input node 30A from the positive DAC 13A, and outputs to the output terminal 16B, a same drive voltage as the negative gray scale voltage supplied to the input node 30B from the negative DAC 13B. On the other hand, when the negative drive voltage is outputted to the output terminal 16A, and the positive drive voltage is outputted to the output terminal 16B, the output node 36C of the common output stage 28 is connected to the output terminal 16B, and the output node 36B of the negative-only output stage 24B is connected to the output terminal 16A. In this case, the output amplifier circuit 14 of FIGS. 7 and 8 operates as a voltage follower that outputs to the output terminal 16B, a same drive voltage as the positive gray scale voltage supplied to the input node 30A from the positive DAC 13A, and outputs to the output terminal 16A, a same drive voltage as the negative gray scale voltage supplied to the input node 30B from the negative DAC 13B. At this time, in order to reduce the amplitude difference deviation between the drive voltages outputted from the output terminals 16A and 16B, the connections among the input nodes 30A and 30B, the differential stages 22A and 22B, and the common and negative-only output stages 28 and 24B are switched in appropriate periods.

In such an operation, in the common output stage 28, the NMOS transistor MN78 is used to pull down the output node 36C, and a gate of the NMOS transistor MN78 is driven by the NMOS transistor MN74 of the common output stage 28 and the NMOS transistor MN16 or MN26 of the differential stage 22A or 22B. At this time, as the NMOS transistor MN78, the normal enhancement type NMOS transistor is used, and therefore an operating margin large enough to operate the NMOS transistors MN74 and MN16 (or MN26) can be ensured. The problem of the insufficient operating margin of the positive-only output stage 24A as in the output amplifier circuit 14 of FIGS. 3 and 4 does not arise.

(Operation in Half VDD Mode)

Referring to FIG. 9 again, when the output amplifier circuit 14 is set to the half VDD mode, the positive-only output stage 24A is used to output the positive drive voltage, whereas an output stage that outputs the negative drive voltage is selected from the common output stage 28 and negative-only output stage 24B depending on the presence or absence of polarity inversion of the drive voltage. Specifically, when a data line is to be driven with a drive voltage with a polarity which is opposite to (or inverted from) the polarity of the voltage remaining in a data line 6 just before, the common output stage 28 is used, whereas when the data line is to be driven with the drive voltage with non-inverted (non opposite) polarity, the negative-only output stage 24B is used.

Figure 11A:
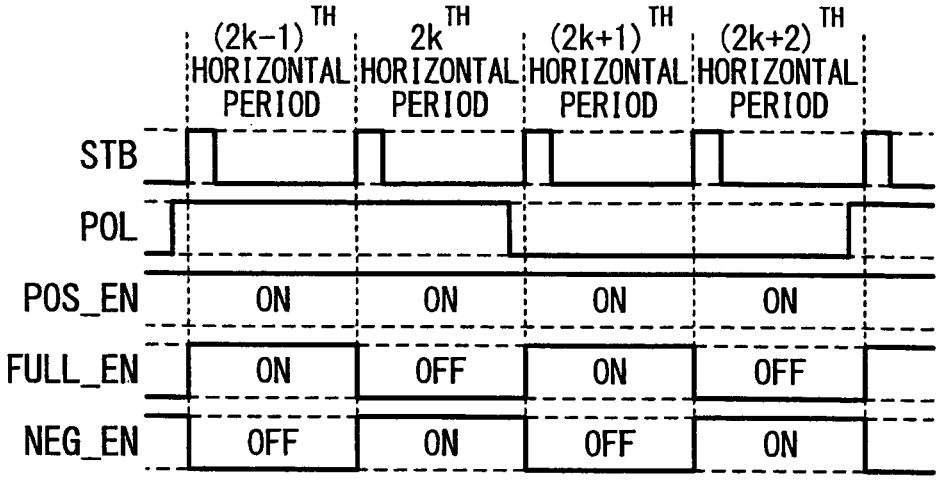
FIG. 11A is a timing chart illustrating an operation of the output amplifier circuit for the case of half VDD mode setting in one embodiment of the present invention.

FIG. 11A shows timing charts of the operation of the output amplifier circuit 14 when the output amplifier circuit 14 is set to the half VDD mode. In the operation example of FIG. 11A, a polarity of the drive voltage is switched every two horizontal periods, i.e., so-called 2H inversion driving is performed. It should be noted that in the 2H inversion driving, the polarity signal POL is inverted every two horizontal periods. The operation will be described when during an odd-numbered horizontal period ($(2i-1)^{th}$ horizontal period), each data line 6 is driven with a drive voltage having a polarity opposite to that in the last horizontal period, and during an even-numbered horizontal period ($2i^{th}$ horizontal period), each data line 6 is driven with a drive voltage having a same polarity as that in the last horizontal period.

A data line 6 when a polarity of a drive voltage is inverted is driven by the following procedure: First, the polarity signal POL is inverted. In the example of FIG. 11A, the polarity signal POL is inverted from the Low level to the High level at the end of a $(2k-2)^{th}$ horizontal period just before the $(2k-1)^{th}$ horizontal period.

A strobe signal STB is asserted, simultaneously at the start of the $(2k-1)^{th}$ horizontal period, and image data D(1) to D(n) on pixels 8 driven during the $(2k-1)^{th}$ horizontal period are taken in by the latch circuits 11A and 11B. Along with the assertion of the strobe signal STB, the positive-only output stage selection signal POS_EN and the common output stage selection signal FULL_EN are asserted, and the negative-only output stage selection signal NEG_EN is negated. As a result, the positive-only output stage 24A and the common output stage 28 are selected as output stages generating the drive voltages. Subsequently, the positive drive voltage is outputted from the positive-only output stage 24A, and the negative drive voltage is outputted from the common output stage 28.

At this time, the positive drive voltage is outputted from the common output stage 28; however, the back gate of the PMOS transistor MP78 of the common output stage 28 is applied with the power supply voltage VDD, and therefore a parasitic PNP bipolar transistor of the PMOS transistor MP78 is not turned on. In the output amplifier circuit 14 of FIGS. 7 and 8, the problem does not arise that the parasitic PNP bipolar transistor is turned on as in the negative-only output stage 24B of the output amplifier circuit 14 of FIGS. 3 and 4.

On the other hand, a data line 6 when the polarity of the drive voltage is not inverted is driven by the following procedure: The polarity signal POL is kept at the same signal level as that during a last horizontal period. In the example of FIG. 11A, the polarity signal POL during a $2k^{th}$ horizontal period during which the polarity of the drive voltage is not inverted is in the same High level as that during the last $(2k-1)^{th}$ horizontal period. Simultaneously at the start of the $2k^{th}$ horizontal period, the strobe signal STB is asserted, and image data D(1) to D(n) on pixels 8 driven during the $2k^{th}$ horizontal period are taken in by the latch circuit 11A and 11B. Along with the assertion of the strobe signal STB, the positive-only output stage selection signal POS_EN and the negative-only output stage selection signal NEG_EN are asserted, and the common output stage selection signal FULL_EN is negated. As a result, the positive-only output stage 24A and the negative-only output stage 24B are selected as output stages generating the drive voltages. Subsequently, the positive drive voltage is outputted from the positive-only output stage 24A, and the negative drive voltage is outputted from the negative-only output stage 24B. The use of the negative-only output stage 24B that uses the intermediate power supply voltage VDD/2 to operate is effective for reduction in a power consumption amount.

Figure 11B:
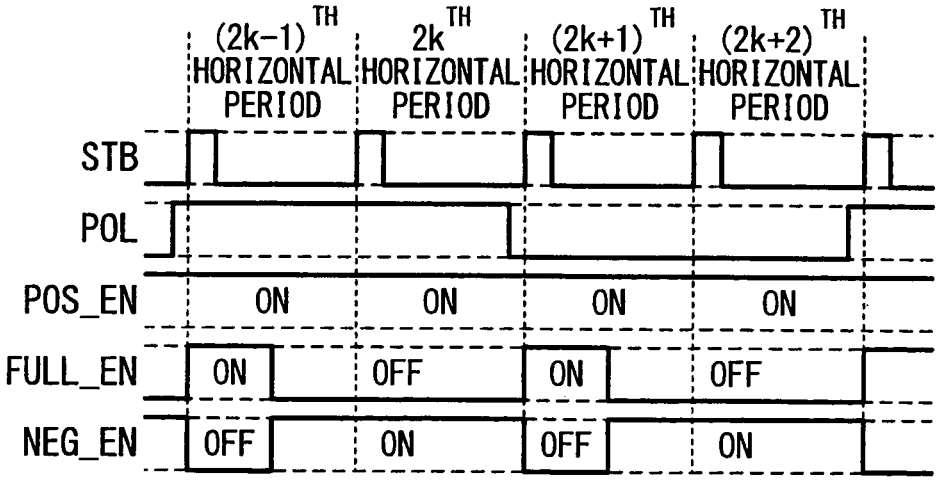
FIG. 11B is a timing chart illustrating the operation of the output amplifier circuit for the case of the half VDD mode setting in one embodiment of the present invention.

There is also possible operation in which the common output stage 28 is used when the polarity of the drive voltage is inverted, and then an output stage keeping the negative drive voltage in the data line 6 is switched from the common output stage 28 to the negative-only output stage 24B in the middle of a horizontal period. FIG. 11B shows timing charts in the case of such an operation.

After the polarity signal POL is inverted from the Low level to the High level at the end of a $(2k-2)^{th}$ horizontal period, along with the start of a $(2k-1)^{th}$ horizontal period, the strobe signal STB is asserted, and image data D(1) to D(n) on pixels 8 driven during the $(2k-1)^{th}$ horizontal period are taken in by the latch circuit 11A and 11B. Simultaneously with the assertion of the strobe signal STB, the positive-only output stage selection signal POS_EN and the common output stage selection signal FULL_EN are asserted, and the negative-only output stage selection signal NEG_EN is negated. As a result, the positive-only output stage 24A and the common output stage 28 are selected as output stages generating the drive voltages. Subsequently, the positive drive voltage is outputted from the positive-only output stage 24A, and the negative drive voltage is outputted from the common output stage 28. After that, the common output stage selection signal FULL_EN is negated, and the negative-only output stage selection signal NEG_EN is asserted. As a result of this, an output stage keeping the negative drive voltage generated in the data line 6 is switched from the common output stage 28 to the negative-only output stage 24B. In one embodiment, timing at which the output stage keeping the negative drive voltage is switched from the common output stage 28 to the negative-only output stage 24B is fixed to a time after a predetermined time has passed since the start of the horizontal period.

One of important points in such an operation is to reliably prevent a higher voltage than the intermediate power supply voltage VDD/2 from being applied to the output of the negative-only output stage 24B. Also, making as short as possible a time during which the common output stage 28 is used is preferable from the viewpoint of reduction in a power consumption amount. From such a viewpoint, the timing at which the output stage keeping the negative drive voltage is switched from the common output stage 28 to the negative-only output stage 24B is preferably determined in response to voltage at the output terminal 16A or 16B connected to the data line 6 to be driven by the negative drive voltage. The voltage at each of the output terminals 16A and 16B is sensed, and if it is sensed that the voltage at the output terminal 16A or 16B connected to the data line 6 to be driven by the negative drive voltage becomes lower than the intermediate power supply voltage VDD/2, the common output stage selection signal FULL_EN is negated, and the negative-only output stage selection signal NEG_EN is asserted. Thus, the output stage keeping the negative drive voltage generated in the data line 6 is switched from the common output stage 28 to the negative-only output stage 24B. Such an operation is effective for reliably preventing a higher voltage than the intermediate power supply voltage. VDD/2 from being applied to the output of the negative-only output stage 24, and making as short as possible the time during which the common output stage 28 is used.

Figures 12, 13:
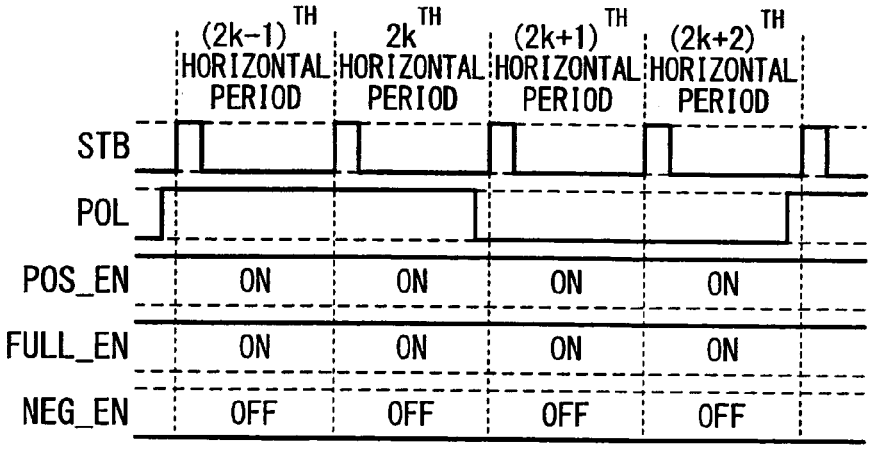
FIG. 12 is a table illustrating an operation of an output amplifier circuit in another embodiment of the present invention.
FIG. 13 is a timing chart illustrating an operation of the output amplifier circuit for the case of the half VDD mode setting in another embodiment of the present invention.

Also, as illustrated in FIGS. 12 and 13, when the output amplifier circuit 14 is set to the half VDD mode, the common output stage 28 can also be used to always output the negative drive voltage. Even such an operation can reliably prevent a higher voltage than the intermediate power supply voltage VDD/2 from being applied to the output of the negative-only output stage 24B. Always using the common output stage 28 when the output amplifier circuit 14 is set to the half VDD mode is effective for simplifying control logics of the intermediate switch circuit 23, the feedback system switch circuit 25, and the output side switch circuit 26.

As described above, the various embodiments of the present invention has been described; however, the present invention shall not be construed as a limitation to the above-described embodiments. For example, in the configuration of the output amplifier circuit 14 in FIGS. 7 and 8, as the NMOS transistor MN17 of the positive-only output stage 24A, the depletion type transistor is used, whereas as the PMOS transistor MP28 of the negative-only output stage, a normal PMOS transistor may be used. Even in this case, in the case of the full VDD mode setting, by using not the positive-only output stage 24A but the common output stage 28, the problem of the insufficient operating margin when the intermediate power supply voltage VDD/2 is not supplied can be solved.

Also, in the configuration of the output amplifier circuit 14 in FIGS. 7 and 8, as the PMOS transistor MP28 of the negative-only output stage 24B, the PMOS transistor of which the well is separated from the other PMOS transistors and the back gate is connected to the source is used, whereas as the NMOS transistor MN17 of the positive-only output stage 24A, an enhancement type NMOS transistor may be used. Even in this case, by using the common output stage 28, instead of the negative-only output stage 24B, for the polarity inversion of the drive voltages for the case of the half VDD setting, the problem of turning on of the parasitic PNP bipolar transistor can be avoided.

Further, one skilled in the art could understand that the configuration of: a circuit section driving the gates of the PMOS transistor MP18 and the NMOS transistor MN18, which are the output transistors of the positive-only output stage 24A; a circuit section driving the gates of the PMOS transistor MP28 and the NMOS transistor MN28, which are the output transistors of the negative-only output stage 24B; and a circuit section driving the gates of the PMOS transistor MP78 and the NMOS transistor MN78, which are the output transistors of the common output stage 28 can be variously modified. In addition, one skilled in the art could understand that the configuration of the differential stages 22A and 22B can be variously modified.

Figure 14:
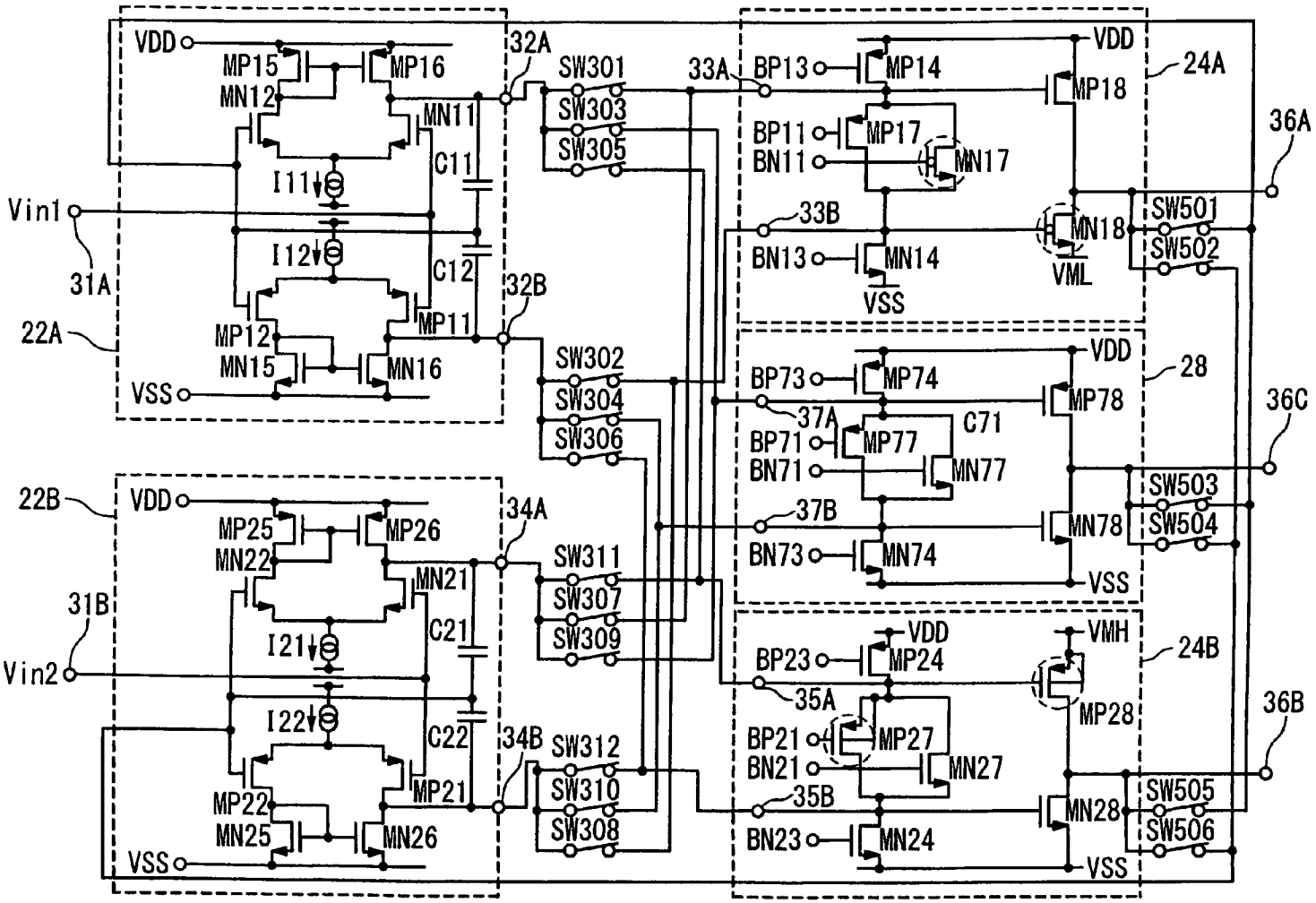
FIG. 14 is a diagram illustrating configurations of differential stages, and positive-only, negative-only, and positive-negative shared output stages in another embodiment of the present invention.

FIG. 14 is a diagram illustrating an example of another configuration of the positive-only output stage 24A, the negative-only output stage 24B, and the common output stage 28, and the differential stages 22A and 22B. In the configuration of FIG. 14, the differential stage 22A includes the PMOS transistors MP11, MP12, MP15, and MP16, the NMOS transistors MN11, MN12, MN15, and MN16, the constant current sources I11 and I12, and the capacitors C11 and C12. On the other hand, the differential stage 22B includes the PMOS transistors MP21, MP22, MP25, and MP26, the NMOS transistors MN21, MN22, MN25, and MN26, the constant current source I21 and I22, and the capacitors C21 and C22. Also, the positive-only output stage 24A includes the PMOS transistors MP14, MP17, and MP18, and the NMOS transistors MN14, MN17, and MN18, and the negative-only output stage 24B includes the PMOS transistors MP24, MP27, and MP28, and the NMOS transistors MN24, MN27, and MN28. Further, the common output stage 28 includes the PMOS transistors MP74, MP77, and MP78, and the NMOS transistors MN74, MN77, and MN78.

It should be noted that, in the configuration of FIG. 14, the phase compensation capacitors C11, C12, C21, and C22 are provided (not in the output stages but) in the differential stages 22A and 22B. The configuration in which the phase compensation capacitors are provided in the differential stages 22A and 22B is effective for reduction in the number of phase compensation capacitors. In the configuration illustrated in FIG. 8 in which the phase compensation capacitors are provided in the output stages, the six phase compensation capacitors are required; however, in the configuration illustrated in FIG. 14 in which the phase compensation capacitors are provided in the differential stages 22A and 22B, only the four phase compensation capacitors are required. It should be noted that the configuration in which the phase compensation capacitors are provided in the differential stages 22A and 22B is also applicable to the configuration of FIG. 8.

Even in the configuration of FIG. 12, a basic operation is the same as that in the configuration of FIG. 8. One skilled in the art could easily understand that the configuration of the positive-only output stage 24A, the negative-only output 24B, and the common output stage 28, and the differential stages 22A and 22B can also be variously modified beyond the example illustrated in FIG. 12.

Also, it should be noted that in the present embodiment, as the intermediate power supply voltage, a half voltage of the power supply voltage VDD/2 is used; however, strictly, the intermediate power supply voltage is not required to be the half voltage of the power supply voltage VDD/2. The intermediate power supply voltage is only required to be a voltage that is lower than the lowest gray scale voltage $V_{GS1}^{+}$ among the positive gray scale voltages and higher than the lowest gray scale voltage $V_{GS1}^{-}$ among the negative gray scale voltages.

What is claimed is:

1. A display panel driver comprising:

an output amplifier circuit;

a first output terminal; and a second output terminal, wherein said output amplifier circuit comprises:

a first output stage configured to receive a power supply voltage and a first voltage lower than said power supply voltage and to output a drive voltage in a first voltage range defined between said power supply voltage and a middle power supply voltage which is higher than a ground voltage and is lower than said power supply voltage; and a second output stage configured to receive said power supply voltage and the ground voltage and to output a drive voltage between said power supply voltage and said ground voltage, wherein said first output stage comprises a first pull-down output transistor configured to pull down an output terminal of said first output stage, wherein said second output stage comprises a second pull-down output transistor configured to pull down an output terminal of said second output stage, wherein said first pull-down output transistor is a depletion-type NMOS transistor, wherein said second pull-down output transistor is an enhancement-type NMOS transistor, wherein when said output amplifier circuit is set to a first mode that said first voltage is set as said middle power supply voltage, said first output stage outputs a first drive voltage in said first voltage range to one of said first output terminal and said second output terminal, and wherein when said output amplifier circuit is set to a second mode that said first voltage is set as said ground voltage, said second output stage outputs a first drive voltage in said first voltage range to one of said first output terminal and said second output terminal.

2. The display panel driver according to claim 1, further comprising:

a third output stage configured to receive said ground voltage and a second voltage which is higher than said ground voltage and to output a drive voltage in a second voltage range defined between said ground voltage and said middle power supply voltage, wherein said second voltage is set to said middle power supply voltage when said output amplifier circuit is set to said first mode, and is set to said power supply voltage when said output amplifier circuit is set to said second mode, wherein said third output stage comprises a first pull-up output transistor configured to pull up an output terminal of said third output stage, wherein said second output stage comprises a second pull-up output transistor configured to pull up the output terminal of said second output stage, wherein said first pull-up output transistor is a PMOS transistor, of which a well is separated from other PMOS transistors and a back gate is connected with a source, wherein said second pull-up output transistor is a PMOS transistor, of which a source is supplied with said power supply voltage, wherein when said output amplifier circuit is set to said first mode, said second output stage outputs a second drive voltage in said second voltage range to the other of said first output terminal and said second output terminal in at least a case that a voltage at the other of said first output terminal and said second output terminal is switched from a voltage of said first voltage range to a voltage of said second voltage range, and wherein when said output amplifier circuit is set to said second mode, said third output stage outputs a second drive voltage in said second voltage range to the other of said first output terminal and said second output terminal.

3. The display panel driver according to claim 2, wherein when said output amplifier circuit is set to said first mode, an output stage which maintains the other output terminal to said second drive voltage is switched from said second output stage to said third output stage, after the other output terminal is driven to said second drive voltage by said second output stage.

4. The display panel driver according to claim 3, wherein a timing at which the output stage which maintains the other output terminal to said second drive voltage is switched from said second output stage to said third output stage is controlled based on a voltage of the other said output terminal.

5. The display panel driver according to claim 1, wherein said first output stage comprises:

a third pull-up output transistor as a PMOS transistor configured to pull up the output terminal of said first output stage; and a first floating current source connected between a gate of said first pull-down output transistor and a gate of said third pull-up output transistor, wherein said first floating current source comprises a first PMOS transistor and a first NMOS transistor, wherein a source of said first PMOS transistor is connected with a drain of said first NMOS transistor and a source of said first NMOS transistor is connected with a drain of said first PMOS transistor, and wherein said first NMOS transistor is a depletion-type NMOS transistor.

6. The display panel driver according to claim 2, wherein said third output stage comprises:

a third pull-down output transistor as an NMOS transistor configured to pull down the output terminal of said first output stage; and a second floating current source connected between a gate of said first pull-up output transistor and a gate of said third pull-down output transistor, wherein said second floating current source comprises a second PMOS transistor and a second NMOS transistor, a source of said second PMOS transistor is connected with a drain of said second NMOS transistor and a source of said second NMOS transistor is connected with a drain of said second PMOS transistor, and wherein said second PMOS transistor is a PMOS transistor, of which a well is separated from other PMOS transistors and a back gate is connected with a source.

7. A display panel driver comprising:

an output amplifier circuit;

a first output terminal; and a second output terminal, wherein said output amplifier circuit comprises:

a first output stage configured to output a drive voltage in a first voltage range between a power supply voltage and a middle power supply voltage which is higher than a ground voltage and is lower than said power supply voltage;

a second output stage configured to receive said power supply voltage and said ground voltage and to output a drive voltage between said power supply voltage and said ground voltage; and a third output stage configured to receive said ground voltage and a second voltage which is higher than said ground voltage and to output a drive voltage in a second voltage range between said ground voltage and said middle power supply voltage, wherein said third output stage comprises a first pull-up output transistor configured to pull up an output terminal of said third output stage, wherein said second output stage comprises a second pull-up output transistor configured to pull up an output terminal of said second output stage, wherein said first pull-up output transistor is a PMOS transistor, of which a well is separated from other PMOS transistors and a back gate is connected with a source, wherein said second pull-up output transistor is a PMOS transistor of which a source is supplied with said power supply voltage, wherein when said output amplifier circuit is set to a first mode in which said second voltage is set to said middle power supply voltage, said second output stage outputs a second drive voltage in said second voltage range to one of said first output terminal and said second output terminal in at least a case that a voltage at said one output terminal is switched from a voltage in said first voltage range to a voltage in said second voltage range, and wherein when said output amplifier circuit is set to a second mode in which said second voltage is set to said power supply voltage, said third output stage outputs a second drive voltage in said second voltage range to said one output terminal.

8. The display panel driver according to claim 7, wherein when said output amplifier circuit is set to said first mode, the output stage which maintains said one output terminal to said second drive voltage is switched from said second output stage to said third output stage, after said output terminal is driven to said second drive voltage by said second output stage.

9. A display apparatus comprising:

a display panel comprising a first data line and a second data line; and a display panel driver, wherein said display panel driver comprises:

an output amplifier circuit;

a first output terminal connected with said first data line; and a second output terminal connected with said second data line, wherein said output amplifier circuit comprises:

a first output stage configured to receive a power supply voltage and a first voltage which is lower than said power supply voltage, and output a drive voltage in a first voltage range between said power supply voltage and a middle power supply voltage which is higher than a ground voltage and is lower than said power supply voltage; and a second output stage configured to receive said power supply voltage and said ground voltage and output a drive voltage between said power supply voltage and said ground voltage, wherein said first output stage comprises a first pull-down output transistor configured to pull down an output terminal of said first output stage, wherein said second output stage comprises a second pull-down output transistor configured to pull-down an output terminal of said second output stage, wherein said first pull-down output transistor is a depletion-type NMOS transistor, and said second pull-down output transistor is an enhancement-type NMOS transistor, wherein when said output amplifier circuit is set to a first mode in which said first voltage is set as said middle power supply voltage, said first output stage outputs a first drive voltage in said first voltage range to one of said first output terminal and said second output terminal, and wherein when said output amplifier circuit is set to a second mode in which said first voltage is set as said ground voltage, said second output stage outputs the first drive voltage in said first voltage range to said one output terminal of said first output terminal and said second output terminal.

10. A display apparatus comprising:

a display panel comprising a first data line and a second data line; and a display panel driver, wherein said display panel driver comprises:

an output amplifier circuit;

a first output terminal connected with said first data line; and a second output terminal connected with said second data line, wherein said output amplifier circuit comprises:

a first output stage configured to output a drive voltage in a first voltage range between a power supply voltage and a middle power supply voltage which is higher than a ground voltage and is lower than said power supply voltage;

a second output stage configured to receive said power supply voltage and said ground voltage and to output a drive voltage between said power supply voltage and said ground voltage; and a third output stage configured to receive said ground voltage and a second voltage which is higher than said ground voltage and to output in a drive voltage in a second voltage range between said ground voltage and said middle power supply voltage, wherein said third output stage comprises a first pull-up output transistor configured to pull up an output terminal of said third output stage, and said second output stage comprises a second pull-up output transistor configured to pull up an output terminal of said second output stage, wherein said first pull-up output transistor is a PMOS transistor, of which a well is separated from other PMOS transistors and a back gate is connected with a source, and said second pull-up output transistor is a PMOS transistor, of which a source is supplied with said power supply voltage, wherein when said output amplifier circuit is set to a first mode in which said second voltage is set as said middle power supply voltage, said second output stage outputs a second drive voltage in said second voltage range to said one output terminal, in at least a case that a voltage of said one output terminal is switched from a voltage in said first voltage range to a voltage in said second voltage range, and wherein when said output amplifier circuit is set to a second mode in which said second voltage is set as said power supply voltage, said third output stage outputs said second drive voltage in said second voltage range to said one output terminal.

* * * * *